US009004882B2

(12) United States Patent
Ohnishi et al.

(10) Patent No.: US 9,004,882 B2
(45) Date of Patent: Apr. 14, 2015

(54) VARIABLE DISPLACEMENT VANE PUMP HAVING MULTIPLE DAMPENING SPRINGS

(75) Inventors: Hideaki Ohnishi, Atsugi (JP); Koji Saga, Ebina (JP); Yasushi Watanabe, Aiko (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 211 days.

(21) Appl. No.: 13/441,037

(22) Filed: Apr. 6, 2012

(65) Prior Publication Data

US 2012/0301342 A1 Nov. 29, 2012

(30) Foreign Application Priority Data

May 23, 2011 (JP) ..... 2011-114718

(51) Int. Cl.

| | |
|---|---|
| ***F04B 17/00*** | (2006.01) |
| ***F04B 1/06*** | (2006.01) |
| ***F04B 49/00*** | (2006.01) |
| ***F01C 20/18*** | (2006.01) |
| ***F04C 2/344*** | (2006.01) |
| ***F04C 14/22*** | (2006.01) |
| ***F04C 14/24*** | (2006.01) |

(52) U.S. Cl.

CPC ..... *F04C 2/3442* (2013.01); *F04C 14/223* (2013.01); *F04C 14/226* (2013.01); *F04C 14/24* (2013.01); *F04C 2270/58* (2013.01); *F04C 2270/80* (2013.01)

(58) Field of Classification Search

CPC ..... F04C 2/38; F04C 2/40; F04C 2/44; F04C 14/18; F04C 14/22; F04C 14/223; F04C 14/226; F04C 14/12; F04C 2210/206; F04C 2/3442; F01C 21/0836

USPC ..... 417/410.3, 221, 218, 364, 212, 213; 418/24, 27, 26, 30, 259

See application file for complete search history.

(56) References Cited

U.S. PATENT DOCUMENTS

| | | | | |
|---|---|---|---|---|
| 3,924,969 | A * | 12/1975 | Rometsch et al. | 417/218 |
| 4,780,069 | A * | 10/1988 | Dantlgraber et al. | 418/26 |
| 5,141,418 | A * | 8/1992 | Ohtaki et al. | 418/26 |
| 5,980,215 | A * | 11/1999 | Robeller et al. | 417/219 |
| 2009/0208352 | A1 * | 8/2009 | Shin et al. | 417/365 |
| 2009/0285707 | A1 * | 11/2009 | Williamson et al. | 418/27 |
| 2010/0221126 | A1 * | 9/2010 | Tanasuca et al. | 417/218 |
| 2012/0213655 | A1 * | 8/2012 | Ohnishi et al. | 418/24 |

FOREIGN PATENT DOCUMENTS

WO WO 2008/003169 A1 1/2008

* cited by examiner

*Primary Examiner* — Bryan Lettman
*Assistant Examiner* — Timothy P Solak
(74) *Attorney, Agent, or Firm* — Crowell & Moring LLP

(57) ABSTRACT

A variable displacement pump includes: a first urging member arranged to urge the cam ring in a direction to increase the eccentric amount; a second urging member arranged to urge the cam ring in a direction to decrease the eccentric amount; a control hydraulic chamber arranged to receive a discharge pressure, and thereby to move the cam ring against the urging force of the first urging member; and a hydraulic pressure introduction section configured to introduce the discharge pressure to the control hydraulic chamber when the discharge pressure becomes greater than a predetermined pressure which is in a range where the cam ring is movable against a resultant force of the urging forces of the first and second urging members, and where the cam ring is not movable only against the urging force of the first urging member.

20 Claims, 11 Drawing Sheets

MAIN GALLERY
MAIN GALLERY
MAIN GALLERY
P
P
Px
P
P
43
51
43a
43b
53
52
44
15
15b
22a
30
28
33
34

MAIN GALLERY
MAIN GALLERY
MAIN GALLERY
P
Px
P
P
53
43a
43b
43
51
52
44
15
15b
28
33
34
22a
30

MAIN GALLERY
MAIN GALLERY
MAIN GALLERY
P
P
P
P
Px
43
51
43b
53
43a
52
54
44
15
22a
30
28
34
33
15b

VARIABLE DISPLACEMENT VANE PUMP HAVING MULTIPLE DAMPENING SPRINGS

BACKGROUND OF THE INVENTION

This invention relates to a variable displacement pump arranged to supply a hydraulic fluid to sliding portions and so on of an internal combustion engine for a vehicle.

U.S. Patent Application Publication No. 2009/0285707 A1 (corresponding to Internal Publication Number WO 2008/003169 A1) discloses a vane type variable displacement oil pump. This variable displacement oil pump includes a first spring arranged to urge a cam ring in a direction (hereinafter, referred to as an eccentric direction) to increase an eccentric amount of the cam ring with respect to a center of a rotation of a rotor, a second spring arranged to urge the cam ring in the eccentric direction when the eccentric amount of the cam ring becomes equal to or smaller than a predetermined amount, and a control hydraulic chamber separated between a pump housing and the cam ring. This variable displacement pump is arranged to control the eccentric amount of the cam ring by urging forces of the first spring and the second spring, and a discharge pressure which is introduced into the control hydraulic chamber, and which is acted to urge the cam ring in a concentric direction (opposite to the eccentric direction) against the spring forces of the first and second springs, and thereby to vary the discharge amount.

When the discharge pressure of the pump becomes equal to a first predetermined hydraulic pressure by the increase of the engine, the cam ring is moved in the concentric direction against the spring force of the first spring until the cam ring is abutted on the second spring. Then, when the discharge pressure of the pump becomes equal to a second predetermined hydraulic pressure by the further increase of the engine speed, the cam ring is further moved in the concentric direction against the spring forces of the first and second springs.

SUMMARY OF THE INVENTION

However, in this variable displacement pump, the eccentric amount of the cam ring is decreased so as to improve the fuel consumption and so on by decreasing the driving torque of the pump. Accordingly, after each of the actuations of the cam ring, that is, in a time period immediately before the second predetermined hydraulic pressure is needed after the discharge pressure reaches the first predetermined hydraulic pressure, and in a time period after the discharge pressure reaches the second predetermined hydraulic pressure, it is desirable that the increase of the discharge pressure according to the increase of the engine speed is not generated.

However, in the conventional variable displacement pump, the springs are used for restricting the actuation of the cam ring. Accordingly, the discharge pressure is increased in accordance with the increase of the engine speed by the amount of the spring constants of the springs at the actuations of the cam ring. Therefore, it is not possible to sufficiently improve the fuel consumption and the output of the engine.

It is, therefore, an object of the present invention to provide a variable displacement pump arranged to decrease a driving torque at actuation of a cam ring.

According to one aspect of the present invention, a variable displacement pump comprises: a rotor driven by an internal combustion engine; a plurality of vanes provided in an outer circumference portion of the rotor, and arranged to be moved in a radially inward direction of the rotor and in a radially outward direction of the rotor; a cam ring which receives the rotor and the vanes therein, which separates a plurality of hydraulic chambers with the rotor and the vanes, and which is arranged to be moved to vary an eccentric amount with respect to a center of a rotation of the rotor, and thereby to increase or decrease volumes of the hydraulic chambers at the rotation of the rotor; a housing which receives the cam ring therein, and which includes a suction portion that is formed in an inner side surface of the housing, that is opened to the hydraulic chambers whose the volumes are increased when the cam ring is moved to one side to be eccentric, and a discharge portion that is formed in the inner side surface of the housing, that is opened to the hydraulic chambers whose the volumes are decreased when the cam ring is moved to the one side to be eccentric; a first urging member arranged to urge the cam ring in a direction to increase the eccentric amount of the cam ring with respect to the center of the rotation of the rotor; a second urging member arranged to urge the cam ring in a direction to decrease the eccentric amount of the cam ring by an urging force smaller than an urging force of the first urging member when the eccentric amount of the cam ring is equal to or greater than a predetermined amount, and arranged so as not to apply the urging force to the cam ring to store the urging force when the eccentric amount of the cam ring is smaller than the predetermined amount; a control hydraulic chamber arranged to receive a discharge pressure, and thereby to move the cam ring against the urging force of the first urging member; and a hydraulic pressure introduction section configured to introduce the discharge pressure to the control hydraulic chamber when the discharge pressure becomes greater than a predetermined pressure which is in a range in which the cam ring is movable with respect to a resultant force of the urging force of the first urging member and the urging force of the second urging member, and in which the cam ring is not movable only with respect to the urging force of the first urging member.

According to another aspect of the invention, a variable displacement pump comprises: a rotor driven by an internal combustion engine; a plurality of vanes provided in an outer circumference portion of the rotor, and arranged to be moved in a radially inward direction of the rotor and in a radially outward direction of the rotor; a cam ring which receives the rotor and the vanes therein, which separates a plurality of hydraulic chambers with the rotor and the vanes, and which is arranged to be moved to vary an eccentric amount with respect to a center of a rotation of the rotor, and thereby to increase or decrease volumes of the hydraulic chambers at the rotation of the rotor; a housing which receives the cam ring therein, and which includes a suction portion that is formed in an inner side surface of the housing, that is opened to the hydraulic chambers whose the volumes are increased when the cam ring is moved to one side to be eccentric, and a discharge portion that is formed in the inner side surface of the housing, that is opened to the hydraulic chambers whose the volumes are decreased when the cam ring is moved to the one side to be eccentric; a first coil spring arranged to urge the cam ring in a direction to increase the eccentric amount of the cam ring with respect to the center of the rotation of the rotor; a second coil spring arranged to urge the cam ring in a direction to decrease the eccentric amount of the cam ring by an urging force smaller than an urging force of the first coil spring when the eccentric amount of the cam ring is equal to or greater than a predetermined amount, and arranged so as not to apply the urging force to the cam ring to store the urging force when the eccentric amount of the cam ring is smaller than the predetermined amount; a control hydraulic chamber arranged to receive a discharge pressure, and thereby to move the cam ring against the urging force of the first coil spring; and a control valve which includes a first connection portion connected with the discharge portion, and a second connection portion connected with the control hydraulic chamber, and which is arranged to control the discharge pressure introduced into the control hydraulic chamber by controlling a connection between the first connection portion and the second connection portion, the control valve being configured to be opened to connect the first connection portion and the second connection portion when the discharge pressure becomes greater than a predetermined pressure which is equal to or greater than a pressure at which the cam ring is movable against a resultant force of the urging force of the first coil spring and the urging force of the second coil spring, and which is equal to or smaller than a pressure at which the cam ring is movable only against the urging force of the first coil spring.

According to still another aspect of the invention, a variable displacement pump comprises: a pump constituting section arranged to increase or decrease volumes of a plurality of hydraulic chambers by rotating a rotor, and thereby to discharge an oil introduced from a suction portion to the hydraulic chambers, from a discharge portion; a variable mechanism which is arranged to vary the volumes of the hydraulic chambers that are opened to the discharge portion by moving a movable member by the discharge pressure of the oil which is generated by the pump constituting section; a first urging member arranged to urge the movable member in a direction to increase variations of the volumes of the hydraulic chambers; a second urging member arranged to urge the movable member in a direction to decrease variations of the volumes of the hydraulic chambers by an urging force smaller than an urging force of the first urging member when the movable member is moved in a direction in which the variations of the volumes of the hydraulic chambers become equal to or greater than a predetermined amount, and arranged not to act the urging force to the movable member while having a set load when the movable member is moved in a direction in which the variations of the volumes of the hydraulic chambers are smaller than a predetermined amount; a control hydraulic chamber arranged to receive the discharge pressure, and thereby to move the movable member against the urging force of the first urging member; a hydraulic pressure introduction section configured to introduce the discharge pressure to the control hydraulic chamber when the discharge pressure becomes greater than a predetermined pressure which is in a range in which the movable member is movable against a resultant force of the urging force of the first urging member and the urging force of the second urging member, and in which the movable member is not movable only against the urging force of the first urging member.

BRIEF DESCRIPTION OF THE DRAWINGS

FIG. 9A shows a state of a section a of FIG. 8. FIG. 9B shows a state of sections b-c of FIG. 8. FIG. 9C shows a state of a section d of FIG. 8.

FIG. 10A shows a state of a section a of FIG. 8. FIG. 10B shows a state of sections b-c of FIG. 8. FIG. 10C shows a state of a section d of FIG. 8.

FIG. 11A shows a state of a section a of FIG. 8. FIG. 11B shows a state of sections b-c of FIG. 8. FIG. 11C shows a state of a section d of FIG. 8.

FIG. 12A shows a state of a section a of FIG. 8. FIG. 12B shows a state of sections b-d of FIG. 8.

DETAILED DESCRIPTION OF THE INVENTION

Figure 1:
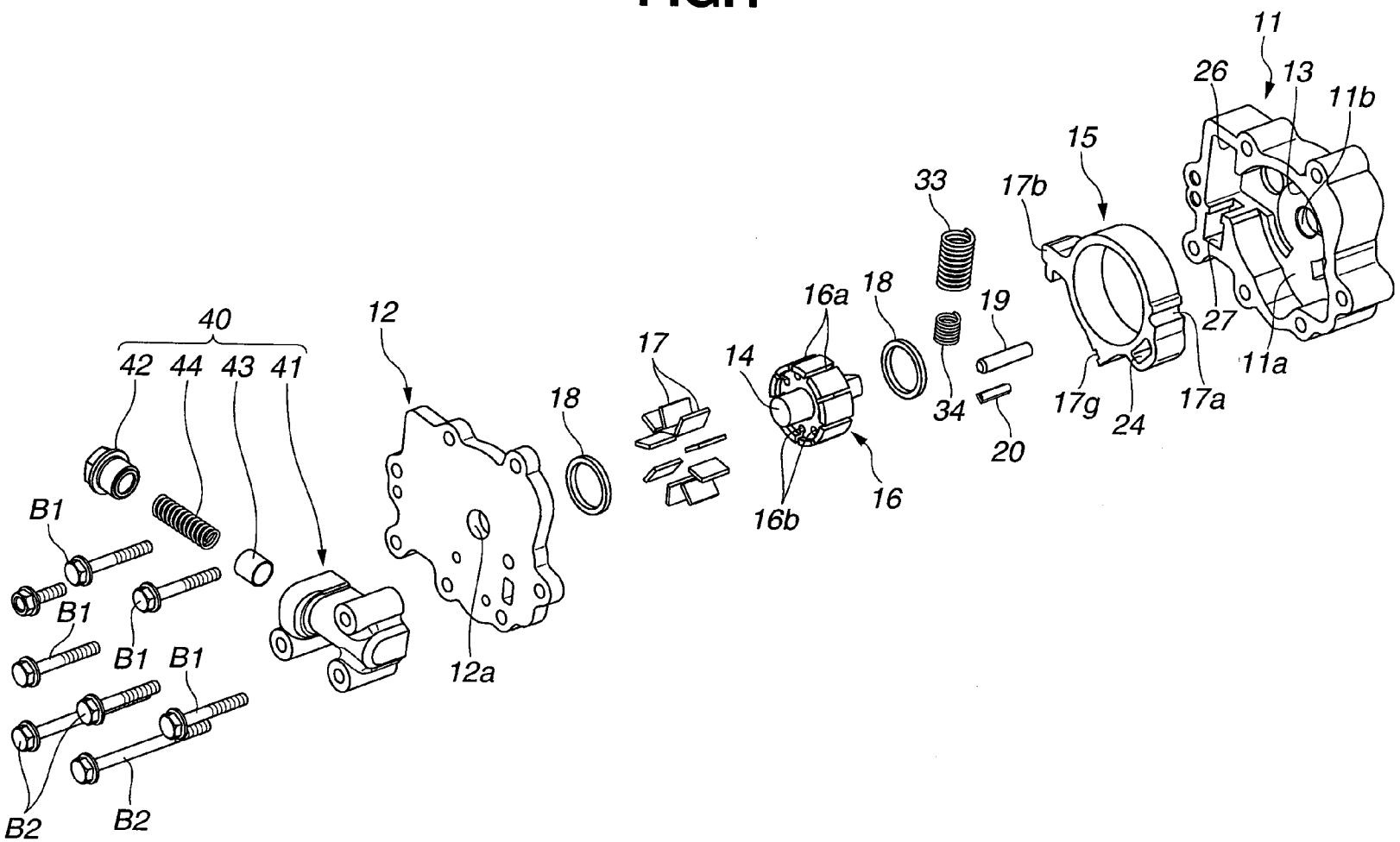
FIG. 1 is an exploded perspective view showing a variable displacement pump according to a first embodiment of the present invention.
Figure 2:
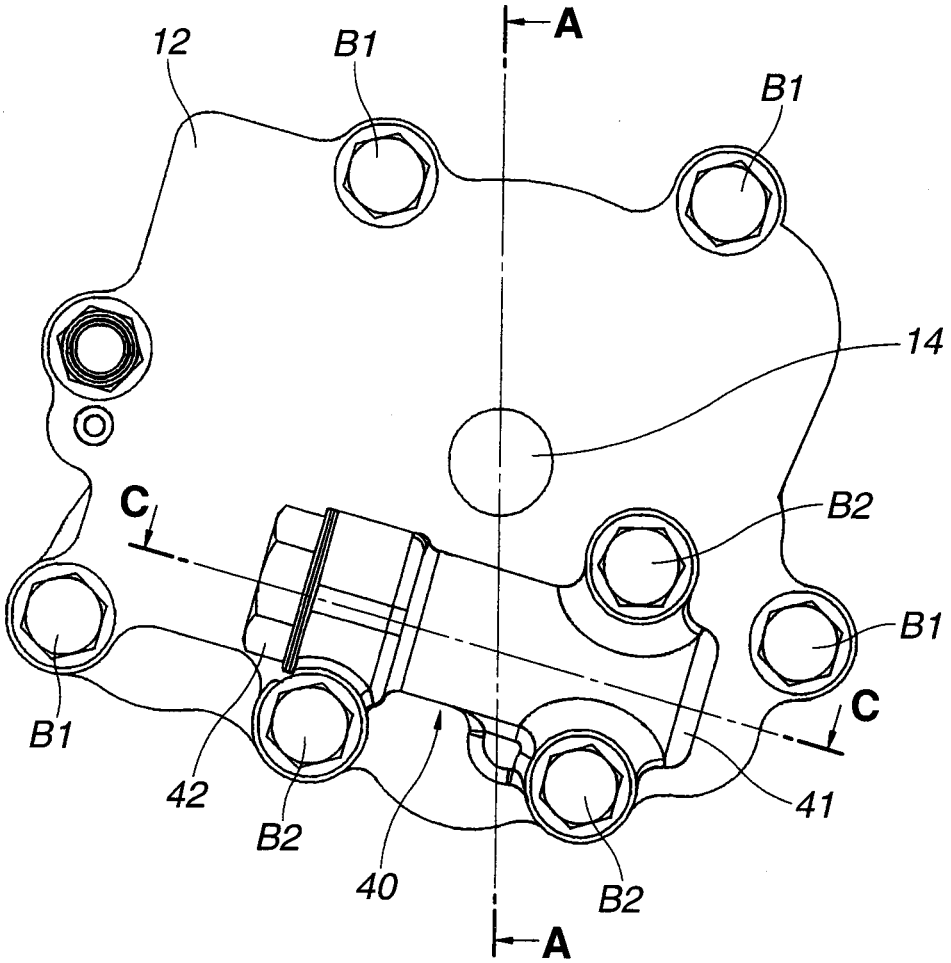
FIG. 2 is a back view showing the variable displacement pump of FIG. 1

Hereinafter, variable displacement pumps according to embodiments of the present invention will be illustrated in detail with reference to the drawings. In these embodiments, the variable displacement pumps according to the present invention are applied as oil pumps arranged to supply a lubricant of an internal combustion engine for a vehicle, to sliding portions of the internal combustion engine, and to a valve timing control apparatus configured to control opening and closing timings of valves of the engine.

FIGS. 1-9 show an oil pump according to a first embodiment of the present invention. As shown in FIGS. 1-4, this oil pump 10 includes a pump housing which is provided at a front end portion of a cylinder block of the internal combustion engine (not shown) and a front end portion of a balancer apparatus, and which includes a pump body 11 which has a substantially U-shaped longitudinal section, and which includes a pump receiving chamber 13 that has an opening located on one end side of pump body 11, and a cover member 12 closing the opening of the pump body 11; a driving shaft 14 which penetrates through a substantially center portion of pump receiving chamber 13, and which is rotatably driven by a crank shaft (not shown), a balancer shaft (not shown) and so on; a cam ring 15 which is a movable member movably (swingably) disposed within pump receiving chamber 13; a pump constituting (forming) section which is disposed radially inside cam ring 15, and which is arranged to increase or decrease volumes of pump chambers PR that are a plurality of hydraulic chambers formed between the pump constituting section and cam ring 15, by being driven by driving shaft 14 in a counterclockwise direction of FIG. 4, and thereby to perform a pump operation; and a control valve 40 which is a hydraulic pressure introduction section that is mounted to the pump housing (cover member 12), and that is arranged to control the swing movement of cam ring 15 by controlling the introduction of the discharge pressure to a control hydraulic chamber 30 (described later).

The pump constituting section includes a rotor 16 which is rotatably received radially inside cam ring 15, and which has a central portion connected to an outer circumference surface of driving shaft 14; vanes 17 each of which is received within one of a plurality of slits 16*a* that are formed by cutting out on the outer circumference portion of rotor 16, and that extend in the radial directions; and a pair of ring members 18 and 18 each of which has a diameter smaller than a diameter of rotor 16, and which are disposed on both side surfaces of rotor 16 on the inner circumference side of rotor 16.

Pump body 11 is integrally formed from aluminum alloy. Pump body 11 includes an end wall 11*a* which constitutes one end wall of pump receiving chamber 13; and a bearing hole 11*b* which is formed at a substantially central position of end wall 11*a*, which penetrates through end wall 11*a*, and which rotatably supports one end portion of driving shaft 14. Moreover, pump body 11 includes a support groove 11*c* which is formed by cutting out on an inner circumference wall of pump receiving chamber 13, which has a substantially semi-circular cross section, and which swingably support cam ring 15 through a rod-like pivot pin 19. Furthermore, pump body 11 includes a seal sliding surface 11*d* which is formed on the inner circumference wall of pump receiving chamber 13, which is located on a lower side in FIG. 4 of a line (hereinafter, referred to as a cam ring reference line) M connecting a center of bearing hole 11*b* and a center of support groove 11*c*, and on which a seal member 20 disposed at an outer circumference portion of cam ring 15 is slidably abutted. This seal sliding surface 11*d* is formed into an arc shape having a predetermined radius R1 from the center of support groove 11*c*. This seal sliding surface 11*d* has a circumferential length by which seal member 20 is constantly slidably abutted on seal sliding surface 11*d* in a range in which cam ring 15 is swung to be eccentric. When cam ring 15 is swung to be eccentric, cam ring 15 is guided to be slidably moved along seal sliding surface 11*d*. With this, it is possible to obtain smooth actuation (eccentric swing movement) of cam ring 15.

Figure 4:
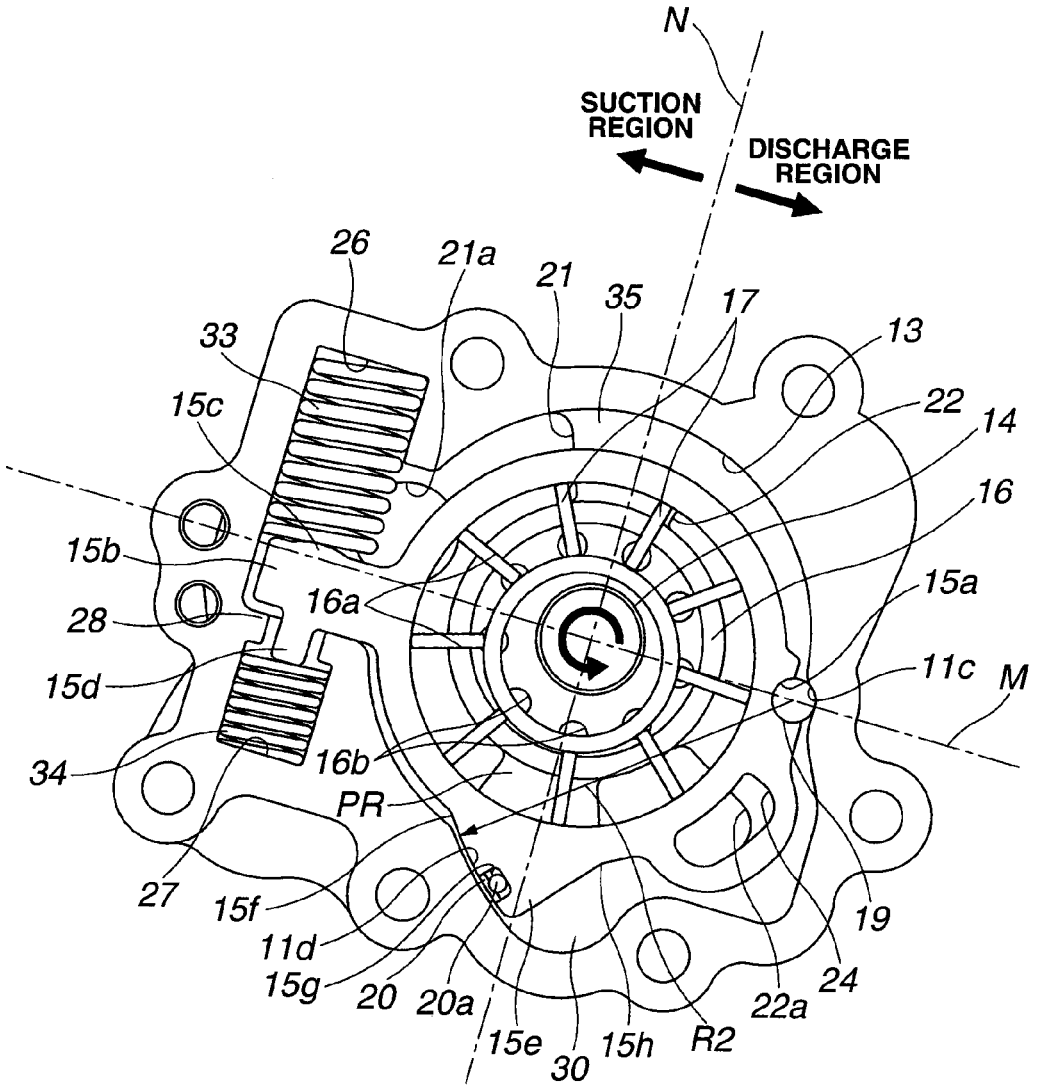
FIG. 4 is a sectional view taken along a section line B-B of FIG. 3.
Figure 5:
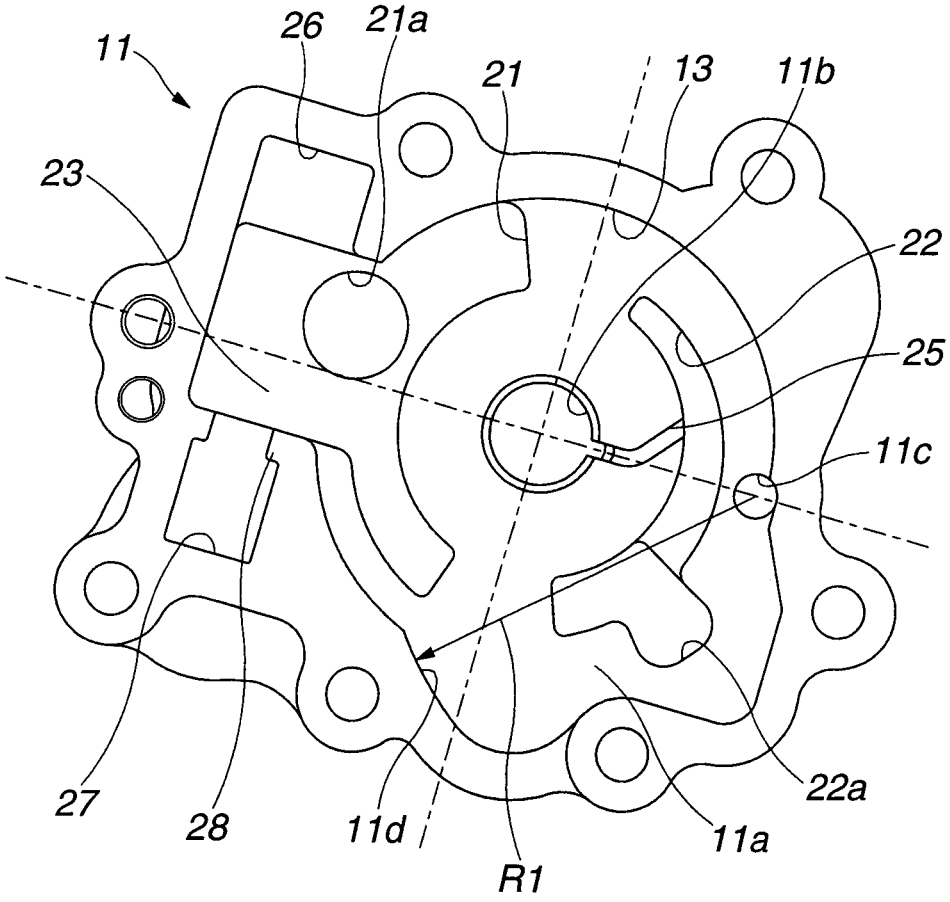
FIG. 5 is a view showing a pump body as viewed from a side of a mating surface with a cover member.

Moreover, as shown in FIGS. 4 and 5, pump body 11 includes a suction port 21 which is a suction portion, which is formed by cutting out on the inner side surface of end wall 11*a* in the outer circumferential region of bearing hole 11*b*, which has a substantially arc recessed shape, and which is opened to a region (hereinafter, referred to as a suction region) in which the volumes of pump chambers PR are increased in accordance with the pump operation of the pump constituting section. Furthermore, as shown in FIGS. 4 and 5, pump body 11 includes a discharge port 22 which is a discharge portion, which is formed by cutting out on the inner side surface of end wall 11*a* in the outer circumferential region of bearing hole 11*b*, which has a substantially arc recessed shape, and which is opened to a region (hereinafter, referred to as a discharge region) in which the volumes of pump chambers PR are decreased in accordance with the pump operation of the pump constituting section. Suction port 21 and discharge port 22 are disposed to substantially confront each other to sandwich bearing hole 11*b*.

Suction port 21 includes an introduction port 23 which is located at a substantially central position of suction port 21 in the circumferential direction, and which expands toward a first spring receiving chamber 26 (described later), and which is integrally formed with suction port 21. Moreover, suction port 21 includes a suction opening 21*a* which is located at a position that is near a boundary between introduction portion 23 and suction port 21, and that is on a start end side of suction port 21, which penetrates through end wall 11*a* of pump body 11, and which is connected with the outside. By the thus-constructed structure, the lubricant stored in an oil pan (not shown) of the internal combustion engine is sucked into pump chambers PR in the suction region through suction opening 21*a* and suction port 21, based on the negative pressure generated in accordance with the pump operation of the pump constituting section. Suction opening 21*a* is connected with introduction port 23, and also a low pressure chamber 35 formed in the suction region in the outer circumference region of cam ring 15. Accordingly, the hydraulic fluid with the low pressure which is the suction pressure is also introduced into the low pressure chamber 35.

Discharge port 22 includes a discharge opening 22*a* which is formed by cutting out, which is located at a start end portion of discharge port 22, which penetrates through end wall 11*a* of pump body 11, and which is opened to the outside. By this structure, the hydraulic fluid which is pressurized by the pump operation of the pump constituting section, and which is discharged to discharge port 22 is supplied from discharge opening 22*a* to the sliding portions (not shown) of the internal combustion engine, the valve timing control apparatus (not shown) and so on, through oil main galleries (not shown) that are provided in the cylinder block. Discharge opening 22*a* has a part formed to expand in the radially outward direction with respect to the discharge port 22. This radially outward expanding part of discharge opening 22*a* is connected with a first connection hole 31 formed in cover member 12, through an inside passage 24 formed within cam ring 15.

At a terminal end portion of discharge port 22, there is formed a connection groove 25 which is formed by cutting out, and which connects discharge port 22 and bearing hole 11*b*. The hydraulic fluid is supplied through this connection groove 25 to bearing hole 11*b*, and also to rotor 16 and side portions of vanes 17. With this, it is possible to ensure the good lubrication of the sliding portions. Connection groove 25 is formed so as not to correspond to the movement directions of vanes 17 in the radially outward direction and in the radially inward direction. With this, it is possible to suppress vanes 17 from dropping into connection groove 25 when vanes 17 are moved in the radially outward direction and in the radially inward direction.

Figure 3:
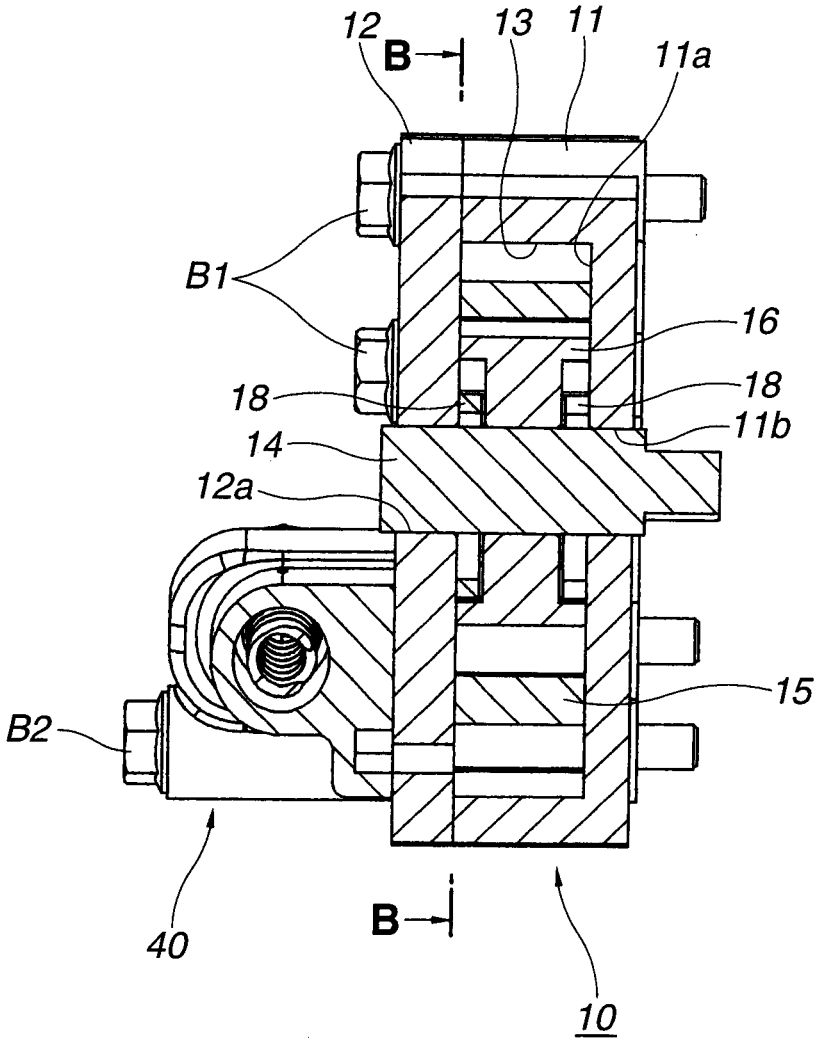
FIG. 3 is a sectional view taken along a section line A-A of FIG. 2.
Figure 6:
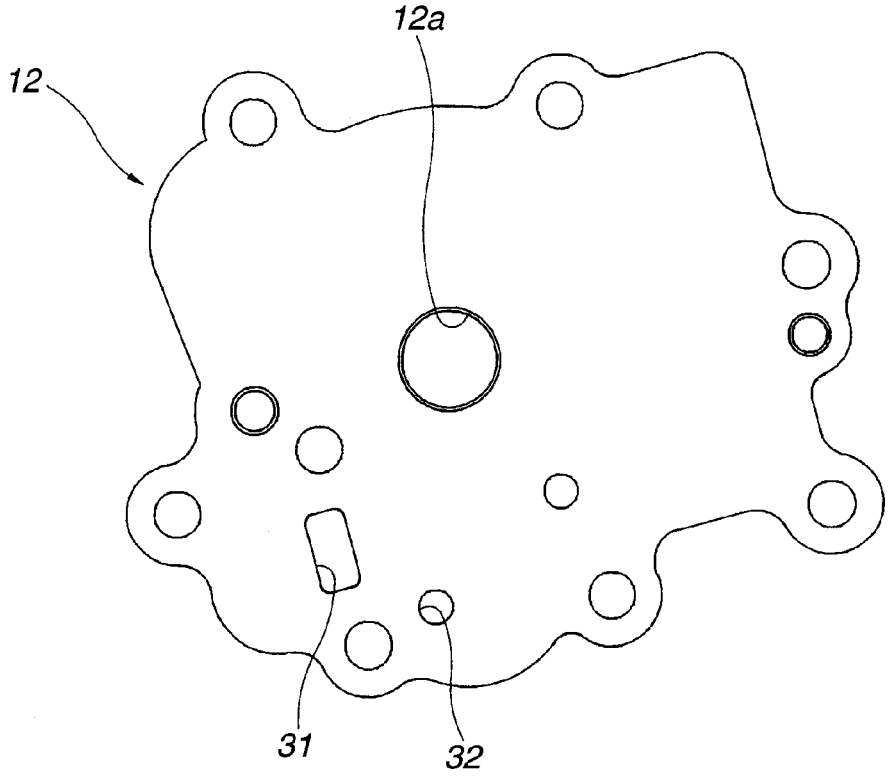
FIG. 6 is a view showing the cover member as viewed from the side of the mating surface with the pump body.

As shown in FIGS. 3 and 6, cover member 12 has a substantially plate shape. Cover member 12 is mounted to the opening end surface of pump body 11 by a plurality of bolts B1. Cover member 12 includes a bearing hole 12*a* which is located at a position to confront bearing hole 11*b* of pump body 11, which penetrates through cover member 12, and which rotatably supports the other end portion of driving shaft 14. This cover member 12 includes first connection hole 31 which is located at a position to confront inside passage 24 of cam ring 15, which penetrates through cover member 12, and which connects discharge opening 22*a* and a first port 51 of a control valve 40 through inside passage 24. Moreover, this cover member 12 includes a second connection hole 32 which is located at a position to confront control hydraulic chambers 30 formed in the discharge region in an outer circumference region of cam ring 15, which penetrates through cover member 12, and which connects control hydraulic chamber 30 and a second port 52 of control valve 40.

As shown in FIG. 3, driving shaft 14 includes an axial end portion (the one end portion) which penetrates through end wall 11*a* of pump body 11 to protrude to the outside, and which is connected to the crank shaft (not shown) and so on. Driving shaft 14 rotates rotor 16 in the counterclockwise direction of FIG. 4 based on a torque (rotational force) transmitted from the crank shaft and so on. In this case, as shown in FIG. 4, a line (hereinafter, referred to as a cam ring eccentric direction line) N perpendicular to cam ring reference line M is a boundary between the suction region and the discharge region.

As shown in FIGS. 1 and 4, rotor 16 includes a plurality of slits 16*a* each formed by cutting out to extend from the center side of rotor 16 in the radially outward direction. Moreover, rotor 16 includes back pressure chambers 16*b* each of which has a substantially circular cross section, each of which is formed at a radially inner end of one of slits 16*a*, and into which the discharge pressure is introduced. Each of vanes 17 is pushed and moved in the radially outward direction by the centrifugal force caused by the rotation of rotor 16 and the pressure within the corresponding back pressure chamber 16*b*.

Each of vanes 17 has a tip end (radially outer end) which is slidably abutted on the inner circumference surface of cam ring 15 at the rotation of rotor 16, and a base end (radially inner end) which is slidably abutted on the outer circumference surfaces of ring members 18 and 18 at the rotation of rotor 16. That is, these vanes 17 are pushed in the radially outward directions by ring members 18 and 18. Accordingly, even when the engine speed is low and the centrifugal force and the pressures of back pressure chambers 16*b* are small, the tip ends of vanes 17 are slidably abutted on the inner circumference surface of cam ring 15 so that pump chambers PR are liquid-tightly separated.

Cam ring 15 is integrally formed from sintered metal into a substantially hollow cylindrical shape. Cam ring 15 includes a pivot portion 15*a* which has a substantially arc recessed shape, which is located at a predetermined position of the outer circumference portion of cam ring 15, which formed by cutting out to extends in the axial direction, and which serves, by being mounted on pivot pin 19, as an eccentric swing point about which cam ring 15 is swung; and an arm portion 15*b* which is located at a position opposite to pivot portion 15*a* with respect to the center of cam ring 15, which protrudes in the radial direction, and which is linked with a first spring 33 having a predetermined spring constant and a second spring 34 having a spring constant smaller than the spring constant of first spring 33. First spring 33 and second spring 34 are disposed on both sides of arm portion 15*b* of cam ring 15 to confront each other. Arm portion 15*b* includes a pressing protrusion portion 15*c* which is formed on one side portion in the movement direction (pivot direction) of arm portion 15*b*, and which has a substantially arc raised portion to protrude; and a pressing protrusion 15*d* which is formed on the other side portion in the movement direction (pivot direction) of arm portion 15*b* to protrude, and which has a length longer than a thickness of a restriction portion 28 (described later). Arm portion 15*b* and first and second springs 33 and 34 are linked with each other by constantly abutting pressing protrusion portion 15*c* on a tip end portion of first spring 33, and by constantly abutting pressing protrusion 15*d* on a tip end portion of second spring 34.

By the thus-constructed structure, as shown in FIGS. 4 and 5, pump body 11 includes first spring receiving chamber 26 which is located at a position to confront support groove 11*c* (at a position opposite to support groove 11*c* with respect to bearing hole 11*b*), and which receives first spring 26, and a second spring receiving chamber 27 which is located at a position to confront support groove 11*c* (at a position opposite to support groove 11*c* with respect to bearing hole 11*b*), and which receives second spring 27. These first spring receiving chamber 26 and second spring receiving chamber 27 are formed adjacent to pump chambers 13 to extend along cam ring eccentric direction line N of FIG. 4. First spring 33 having the predetermined set load W1 is elastically received within first spring receiving chamber 26 between an end wall of first spring receiving chamber 26 and arm portion 15*b* (pressing protrusion portion 15*c*). Second spring 34 having a predetermined set load W2 is elastically received within second spring receiving chamber 27 between an end wall of second spring receiving chamber 27 and arm portion 15*b* (pressing protrusion 15*d*). Second spring 34 has a wire diameter smaller than that of first spring 33. Pump body 11 includes restriction portion 28 which is located between first and second spring receiving chambers 26 and 27, and which has a stepped shape to decrease its diameter. The other side portion (on a lower side of FIG. 4) of arm portion 15*b* is abutted on one side portion (on an upper side of FIG. 4) of restriction portion 28, so that the pivot region of arm portion 15*b* in the counterclockwise direction is restricted. On the other hand, the tip end of second spring 34 is abutted on the other side portion (on the lower side of FIG. 4) of restriction portion 28, so that the maximum elongation of second spring 34 is restricted.

In this way, cam ring 15 is constantly urged through arm portion 15*b* in a direction (in the counterclockwise direction of FIG. 4) in which the eccentric amount of cam ring 15 is increased, by a resultant force (total force) of set loads W1 and W2 of first and second springs 33 and 34, that is, by the urging force of first spring 33 having the relatively large spring load. Accordingly, in the nonactuation state, pressing protrusion 15*d* of arm portion 15*b* enters second spring receiving chamber 27 so as to compress second spring 34. Consequently, the other side portion of arm portion 15*b* is pressed on the one side portion of restriction portion 28, so that cam ring 15 is restricted to a maximum eccentric position.

As shown in FIG. 4, cam ring 15 includes a seal constituting portion 15*e* which is formed at an outer circumference portion of cam ring 15 to protrudes outwards, which has a substantially triangular cross section, and which includes a seal surface 15*f* that has an arc shape having a center identical to the center of seal sliding surface 11*d*, and that is formed to confront seal sliding surface 11*d* of pump body 11. Seal surface 15*f* of this seal constituting portion 15*e* includes a seal holding groove 15*g* which has a substantially rectangular cross section, and which is formed by cutting out to extend in the axial direction. A seal member 20 is received and held within seal holding groove 15*g*. This seal member 20 is slidably abutted on seal sliding surface 11*d* at the eccentric swing movement of cam ring 15.

This seal surface 15*f* has a predetermined radius R2 slightly smaller than radius R1 of seal sliding surface 11*d*. Between seal sliding surface 11*d* and seal surface 15*f*, there is formed a minute clearance. On the other hand, seal member 20 is made from, for example, fluorine resin having low frictional characteristic. Seal member 20 is formed into a linear elongated shape extending in the axial direction of cam ring 15. Seal member 20 is pressed against sliding surface 11*d* by an elastic member 20*a* which is made from rubber, and which is disposed on a bottom portion of seal holding groove 15*g*, so as to liquid-tightly separate between seal sliding surface 11*d* and seal surface 15*f*.

Moreover, in an outer circumference region of cam ring 15, there is formed control hydraulic chamber 30 separated by pivot pin 19 and seal member 20. The discharge pressure is introduced through control valve 40 and second connection hole 32 to this control hydraulic chamber 30. The discharge pressure introduced into this control hydraulic chamber 30 is acted on a pressure receiving surface 15*h* constituted by a side surface of seal constituting portion 15*e* confronting control hydraulic chamber 30, so that cam ring 15 receives the swing force (movement force) in a direction (in the clockwise direction of FIG. 4) to decrease the eccentric amount of cam ring 15. That is, control hydraulic chamber 30 urges cam ring 15 through pressure receiving surface 15*h* by the internal pressure of control hydraulic chamber 30 in a direction (hereinafter, referred to as a concentric direction) in which the center of cam ring 15 approaches the center of the rotation of rotor 16, so that the movement amount of cam ring 15 in the concentric direction is controlled.

In this case, seal sliding surface 11*d* is located on the suction port 21's side of cam ring eccentric direction line N passing through the center of the rotation of rotor 16. Moreover, control hydraulic chamber 30 separated by seal sliding surface 11*d* is located on the discharge port 22's side of cam ring eccentric direction line N. By the above-described disposition of seal sliding surface 11*d* on the suction port 21's side of cam ring eccentric direction line N, the air included in the oil of control hydraulic chamber 30 is discharged by the negative pressure of the suction region to low pressure chamber 35 through the clearance between seal constituting portion 15*e* and the inside surfaces of pump body 11 and cover 12. By the above-described disposition of control hydraulic chamber 30 on the discharge port 22's side of cam ring eccentric direction line N, the oil leaked from pump chambers PR in the discharge region can enter control hydraulic chamber 30, so that the oil is easy to be stored within control hydraulic chamber 30. Accordingly, the internal pressure of control hydraulic chamber 30 is sufficiently acted on pressure receiving surface 15*h*, so that the swing movement of cam ring 15 is appropriately controlled.

By the thus-constructed structure, in this oil pump 10, the urging force in the eccentric direction based on the spring load of first spring 33, and the urging force in the concentric direction based on the spring load of second spring 34 and the internal pressure of control hydraulic chamber 30 are balanced by a predetermined force relationship. When the urging force based on the internal pressure of control hydraulic chamber 30 is smaller than the resultant force W0 (=W1−W2) of the set loads of first and second springs 33 and 34 which is a difference between set load W1 of first spring 33 and set load W2 of second spring 34, cam ring 15 becomes the maximum eccentric state as shown in FIG. 4. On the other hand, when the urging force based on the internal pressure of control hydraulic chamber 30 becomes greater than resultant force W0 of the set loads of first and second springs 33 and 34 in accordance with the increase of the discharge pressure, cam ring 15 is moved in the concentric direction in accordance with the discharge pressure.

Figure 7:
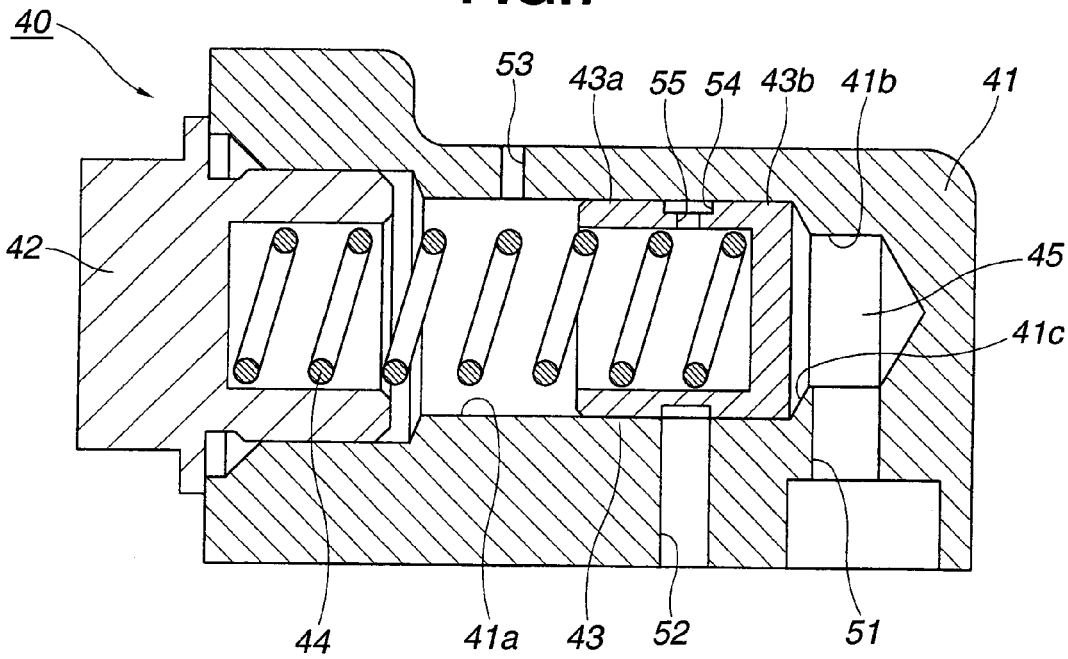
FIG. 7 is a sectional view taken along a section line C-C of FIG. 2.

As shown in FIG. 7, control valve 40 includes a valve body 41 which has a substantially hollow cylindrical shape, and which has a first end opened (on a left side of FIG. 7), and a second end closed (on a right side of FIG. 7); a plug 42 which closes the first open end of valve body 41; a valve element 43 which is received radially within valve body 41 to be slid in an axial direction, which has a first land portion 43*a* and a second land portion 43*b* that are formed at both end portions of valve element 43 in the axial direction, and that are slid with an inner circumference surface of valve body 41; and a valve spring 44 which is elastically received radially within valve body 41 on the first end side of valve body 41 between plug 42 and valve element 43, which is arranged to constantly urge valve element 43 toward the second end side of valve body 41, and which has a predetermined set load Wk identical to the urging force based on a port switching hydraulic pressure Pk. This control valve 40 is disposed on an outer side portion of cover member 12 at a position above control hydraulic chamber 30 in the vertical direction.

Valve body 41 includes a valve hole including a valve element receiving portion 41*a* which has a diameter substantially identical to diameters of land portions 43*a* and 43*b* of valve element 43, and which receives valve element 43; a back pressure chamber forming portion 41*b* which is formed on the second end portion of valve body receiving portion 41*a* to be connected through a stepped portion 41*c* with valve element receiving portion 41*a*, and which has a stepped shape to decrease its diameter relative to that of valve element receiving portion 41*a*. Valve body 41 is fixed to the outer side surface of cover member 12 by the plurality of bolts B2. In a circumference wall of back pressure chamber forming portion 41*b*, there is formed first port (first connection portion) 51 which is directly opened to first connection hole 31 to be connected to first connection hole 31, and which penetrates though the circumferential wall of back pressure chamber forming portion 41. In a circumferential wall of valve body receiving portion 41*a*, there is formed second port (second connection portion) 52 which is directly opened to second connection hole 32 to be connected to second connection hole 32, and which penetrates through the circumferential wall of valve body receiving portion 41*a*; and a third port 53 which is formed on a circumferential region which does not confront cover member 12 (in non-confronting portion opposite to cover member 12 in this embodiment), which has a diameter smaller than a diameter of second port 52, which is a drain hole that is directly opened to the outside, and which penetrates through the circumferential wall of valve body receiving portion 41*a*.

Valve element 43 includes both of land portions 43*a* and 43*b* which are formed by an annular groove that is formed by cutting out a substantially central portion of valve element 43 in the axial direction, and that is continuous in the circumferential direction. Valve element 43 includes an annular space 54 which is separated by both of land portions 43*a* and 43*b* between the inner circumference surface of valve body 41 and valve element 43. Moreover, valve element 43 includes a connection hole 55 which is formed at a predetermined circumferential position of a bottom portion of the annular groove to extend in the radial direction, which connects the inner circumference portion and the outer circumference portion of valve element 43, and which penetrates through valve element 43. With this, second port 52 and third port 53 are arranged to be connected with each other through both of annular space 54 and connection hole 55.

Figures 9A, 9B, 9C:
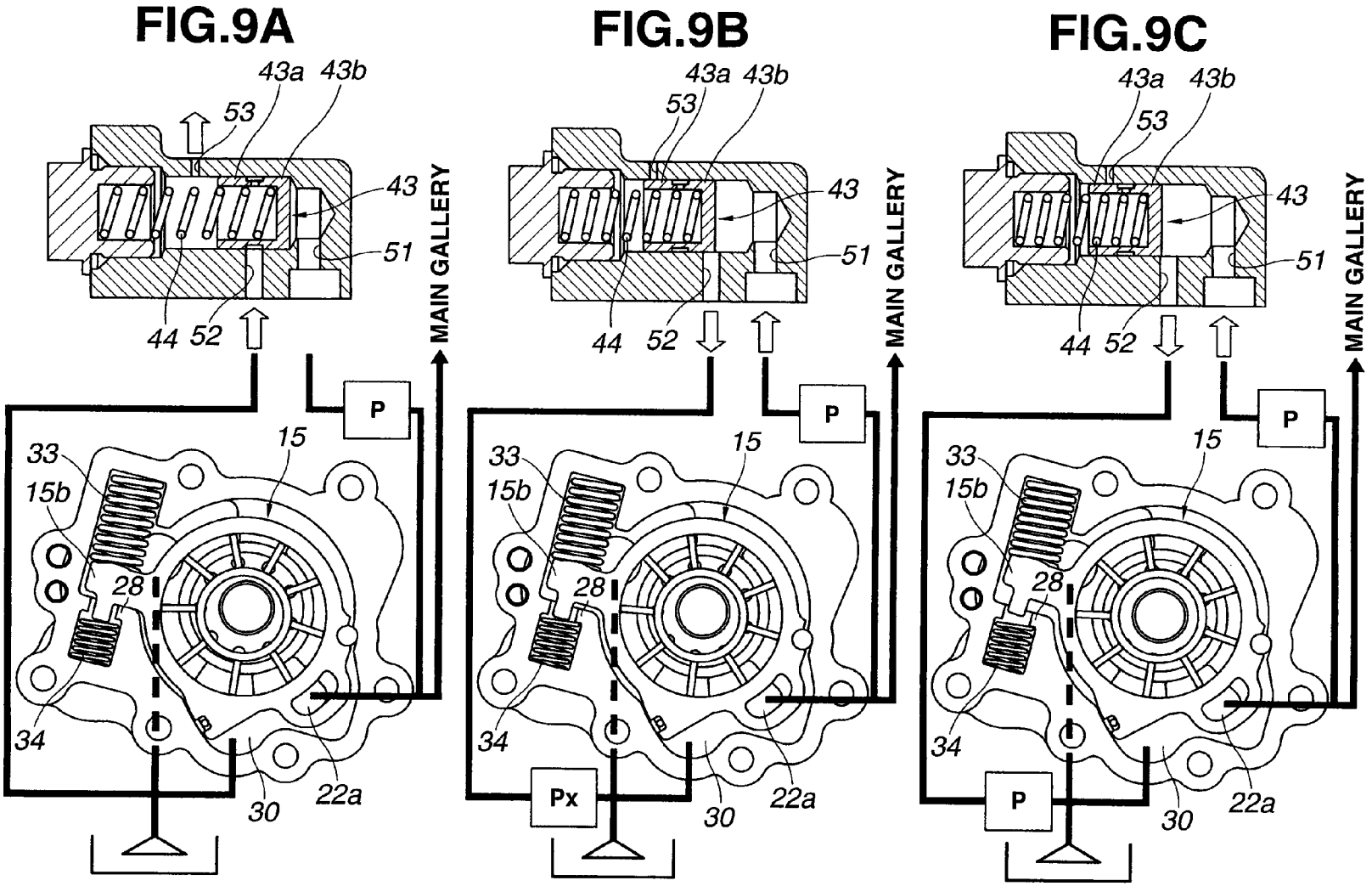
FIGS. 9A-9C are hydraulic pressure circuit diagrams of the variable displacement pump of FIG. 1.

By this structure, when the discharge pressure introduced into back pressure chamber 45 is low and the urging force based on the internal pressure of back pressure chamber 45 is smaller than set load Wk, valve element 43 (second land portion 43*b*) is pressed against stepped portion 41*c* of valve body 41 by the urging force of valve spring 44, as shown in FIG. 9A. With this, first port 51 is closed by second land portion 43*b* (the tip end surface of valve element 43), and second port 52 is connected with third port 53 through annular space 54, connection hole 55, and the inner circumference space of valve body 43. With this, control hydraulic chamber 30 is opened to the air (atmosphere) from second port 52 through annular space 54, third port 53, and so on. That is, second port 52 and third port 53 constitute a discharge passage arranged to discharge the oil within control hydraulic chamber 30 by connecting control hydraulic chamber 30 and the air.

On the other hand, when the discharge pressure introduced into back pressure chamber 45 is increased by the increase of the engine speed of the internal combustion engine, that is, the increase of the rotational speed of oil pump 10, and the urging force based on the internal pressure of back pressure chamber 45 becomes larger than set load Wk of valve spring 44 as shown in FIG. 9B, valve element 43 is moved toward the first end side of valve body 41 (the plug 42 side) by the urging force based on the discharge pressure against the urging force of the valve spring 44. With this, first port 51 is connected to second port 52 through the space separated by second land portion 43*b* within valve body receiving portion 41*a* on the second end side of valve body 41, and third port 53 is closed by first land portion 43*a*. Accordingly, almost all the discharge pressure introduced from first port 51 is introduced into control hydraulic chamber 30. That is, first port 51 and second port 52 constitute a supply passage arranged to supply the discharge pressure to control hydraulic chamber 30 by connecting discharge port 22*a* (first connection hole 31) and control hydraulic chamber 30.

Hereinafter, functions (effects) of the oil pump 10 according to this embodiment are illustrated with reference to FIGS. 8 and 9.

First, a necessary hydraulic pressure of the internal combustion engine is illustrated as a reference of the discharge pressure control of oil pump 10. For example, in a case where a valve timing control apparatus is employed, a symbol P1 in FIG. 8 is a first engine necessary hydraulic pressure corresponding to a hydraulic pressure necessary for the valve timing control apparatus arranged to improve the fuel consumption, and so on. In a case where an oil jet is employed, a symbol P2 in FIG. 8 is a second engine necessary hydraulic pressure corresponding to a hydraulic pressure necessary for the oil jet arranged to cool the piston. A symbol P3 in FIG. 8 is a third engine necessary pressure necessary for lubricating bearing portions of the crank shaft at the high engine speed. A chain line connecting these symbols P1-P3 is an ideal necessary hydraulic pressure (discharge pressure) P corresponding to engine speed R of the internal combustion engine. Besides, a solid line in FIG. 8 represents a characteristic line of the oil pump 10 according to the present invention. A broken line represents a hydraulic characteristic of a conventional pump. Moreover, a symbol Pf in FIG. 8 represents a first actuation hydraulic pressure at which cam ring 15 starts to swing by the urging force based on the internal pressure of control hydraulic pressure 30 against the resultant force of springs 33 and 34. A symbol Ps in FIG. 8 represents a second actuation hydraulic pressure at which cam ring 15 starts to further swing by the urging force based on the internal pressure of control hydraulic pressure 30 against spring load W1 of first spring 33.

Figure 8:
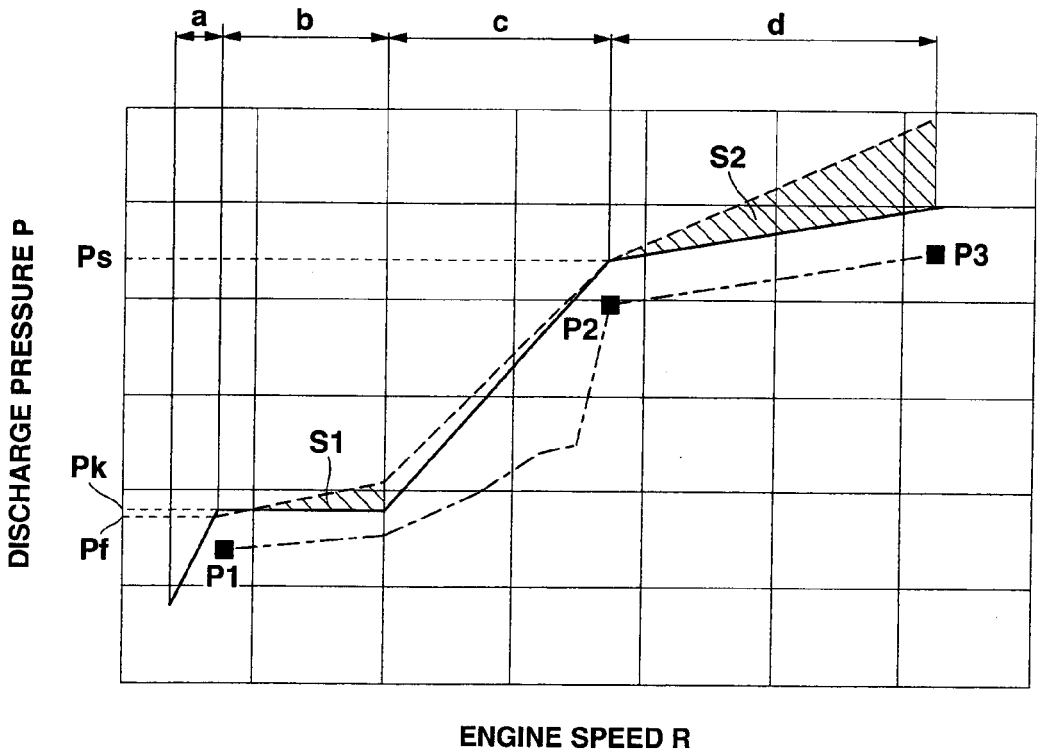
FIG. 8 is a graph showing a hydraulic pressure characteristic of the variable displacement pump of FIG. 1.

That is, in case of oil pump 10, in a section a of FIG. 8 which corresponds to the engine speed from the start of the engine to the low engine speed, the discharge pressure (the hydraulic pressure within the engine) P is smaller than first actuation hydraulic pressure Pf. Accordingly, valve element 43 of control valve 40 is pressed against stepped portion 41*c* of valve body 41, as shown in FIG. 9A. Consequently, first port 51 of control valve 40 is closed, and second port 52 and third port 53 are connected with each other. With this, control hydraulic chamber 30 is connected with third port 53 through control valve 40, so that the oil is not introduced into control hydraulic chamber 30. Cam ring 15 is held to the maximum eccentric state in which arm portion 15*b* is abutted on restriction portion 28, by the resultant force of springs 33 and 34, that is, by the urging force based on the relatively large spring load of the spring load 33. Consequently, the discharge amount of pump 10 is maximized, and the discharge pressure P is increased to be substantially proportional to the increase of engine speed R.

Then, as shown in FIG. 9B, when discharge pressure P reaches port switching hydraulic pressure Pk set slightly larger than first actuation hydraulic pressure Pf by the increase of engine speed R, the urging force based on the internal pressure of back pressure chamber 45 becomes greater than set load of valve spring 44, so that valve element 43 is moved toward plug 42 against set load Wk of valve spring 44. With this, the connection between second port 52 and third port 53 is shut off, and first port 51 and second port 52 are connected with each other, so that discharge pressure P is introduced into control hydraulic chamber 30. Then, when the urging force based on the internal pressure of control hydraulic chamber 30 becomes greater than resultant force W0 of first and second springs 33 and 34 by the introduction of discharge pressure P into control hydraulic pressure 30, cam ring 15 starts to be moved in the concentric direction against the urging force of first spring 33. Consequently, the eccentric amount of cam ring 15 is gradually decreased, so that the increase of the discharge amount is restricted. Therefore, the increase of discharge pressure P based on the increase of engine speed R is suppressed (in a section b in FIG. 8).

In the port switching control by control valve 40, the opening amount of second port 52 of control valve 40 with respect to first port 51 is not sufficient immediately after discharge pressure P reaches port switching hydraulic pressure Pk (the section b in FIG. 8), as shown in FIG. 9B. Discharge pressure P introduced from first port 51 is decreased by the very small opening portion of second port 52, so that a hydraulic pressure Px smaller than discharge pressure P is introduced into control hydraulic chamber 30. With this, the sudden introduction of the hydraulic pressure into control hydraulic chamber 30 is suppressed. Accordingly, it is possible to perform the eccentric movement of cam ring 30 while suppressing the hunting of cam ring 30.

When cam ring 15 is moved in the concentric direction, valve element 43 of control valve 40 is smoothly moved by discharge pressure P corresponding to port switching hydraulic pressure Pk, so that cam ring 15 is smoothly and rapidly moved. Accordingly, in the oil pump 10 according to this embodiment of the present invention, discharge pressure P in this section b is not proportionally increased based on the increase of engine speed R, unlike the conventional pump shown by the broken line of FIG. 8. This discharge pressure P in this section b has a flat characteristic. Accordingly, it is possible to bring closer to the ideal necessary (the chain line in FIG. 8) as much as possible. In the conventional oil pump (the broken line in FIG. 8), discharge pressure P is increased by the amount of the spring constants of the springs in accordance with the increase of engine speed R. On the other hand, in the oil pump according to this embodiment of the present invention, it is possible to decrease the power loss (a region S1 shown by a hatching in FIG. 8) generated by uselessly increasing discharge pressure P.

Then, when second spring 34 extends in accordance with the movement of cam ring 15 in the concentric direction and the tip end (the upper end) of second spring 34 is abutted on restriction portion 28 (cf. FIG. 9B), the urging force of second spring 34 to cam ring 15 does not exist, so that the movement of cam ring 15 in the concentric direction is stopped. Consequently, discharge pressure P of oil pump 10 is again increased in accordance with the increase of engine speed R to be substantially proportional to engine speed R (a section c in FIG. 8).

Then, when discharge pressure P is further increased by the increase of engine speed R by the above-described characteristic, valve element 43 of control valve 40 is moved toward plug 42 from the state shown in FIG. 9B, as shown in FIG. 9C. With this, first port 51 and second port 52 are fully connected with each other. Accordingly, discharge pressure P is not decreased when discharge pressure P is introduced into control hydraulic chamber 30. Consequently, the hydraulic pressure introduced into control hydraulic chamber 30 is substantially identical to the discharge pressure P. Therefore, the internal pressure of control hydraulic chamber 30 and the movement of cam ring 15 based on the internal pressure of control hydraulic pressure 30 are more directly controlled in accordance with discharge pressure P. Accordingly, then, when engine speed R is further increased, discharge pressure P reaches second actuation hydraulic pressure Ps set greater than second engine necessary hydraulic pressure P2. The urging force based on the internal pressure of control hydraulic pressure 30 becomes greater than the urging force of first spring 33, so that cam ring 15 is further moved in the concentric direction. Therefore, the eccentric amount of cam ring 15 is gradually decreased, so that the increase of the discharge pressure (P) is restricted. With this, the increase of discharge pressure P based on the increase of engine speed R is suppressed (a section d in FIG. 8).

In the conventional oil pump (the broken line in FIG. 8), the restriction of the movement of cam ring 15 in the concentric direction in the section d of the engine speed is performed by the urging forces of the two springs. On the other hand, in the oil pump according to this embodiment, the restriction of the movement of cam ring 15 in the concentric direction in the section d of the engine speed is performed only by the urging force of first spring 33. Accordingly, the only minimum control hydraulic pressure (discharge pressure P) is sufficient for the movement of cam ring 15 in the concentric direction. Therefore, it is possible to suppress the power loss (a region S2 shown by the hatching in FIG. 8) caused by uselessly increasing discharge pressure P.

In this way, in the oil pump 10 according to this embodiment of the present invention, the swing movement of cam ring 15 is controlled by increasing discharge pressure P in the multi-step (multi-stage) manner by first and second springs 33 and 34, and control valve 40. Accordingly, discharge pressure P is not uselessly increased. It is possible to obtain a characteristic corresponding to the ideal necessary hydraulic pressure (the chain line) as much as possible (cf. FIG. 8), relative to the conventional oil pump.

That is, in this oil pump 10 according to this embodiment, the hydraulic pressure (the discharge pressure) introduced into control hydraulic chamber 30 is controlled by using control valve 40 at the first actuation of cam ring 15 so that the discharge pressure which is equal to or greater than the predetermined port switching hydraulic pressure Pk set greater than first actuation hydraulic pressure Pf is supplied to control hydraulic pressure 30. With this, it is possible to attain the rapid movement of cam ring 15 against resultant force W0 of first and second springs 33 and 34. Accordingly, it is possible to avoid the influence of the spring constants of first and second springs 33 and 34 at the first actuation of cam ring 15. Therefore, it is possible to suppress the unnecessary increase of the discharge pressure based on the influence of the spring constants, unlike the conventional oil pump.

Moreover, in case of oil pump 10, the movement of cam ring 15 in the concentric direction is restricted only by the urging force of first spring 33 at the second actuation of cam ring 15. Accordingly, it is possible to decrease the hydraulic pressure (the discharge pressure) necessary for the second actuation of cam ring 15 against the urging force of the spring, relative to the conventional oil pump using the two springs for the restriction of the movement of the cam ring in the concentric direction. Consequently, it is possible to ensure the smooth movement of cam ring 15 at the second actuation, and to suppress the unnecessary increase of the discharge pressure which is necessary for acting against the resultant force of the two springs in the conventional oil pump.

That is, it is possible to suppress the unnecessary increase of the discharge pressure at each of the actuations of cam ring 15 as mentioned above, and thereby to suppress the power loss of the pump effectively. Accordingly, it is possible to further bring the discharge characteristic of the pump closer to the ideal characteristic, relative to the conventional oil pump. Consequently, it is possible to improve the fuel consumption, and so on.

Moreover, in the oil pump 10, control valve 40 is disposed at a position above control hydraulic chamber 30 in the vertical direction. With this, it is possible to discharge the air generated in the oil within control hydraulic chamber 30, to the outside through control valve 40. With this, it is possible to suppress the trouble caused by the air accumulated in control hydraulic chamber 30.

In this case, third port 53 is formed as an orifice having a diameter smaller than that of second port 52. With this, it is possible to suppress the variation of the hydraulic pressure within control hydraulic chamber 30. Moreover, it is possible to suppress the leakage of the oil within control hydraulic chamber 30. Therefore, it is possible to improve the response at the switching of ports.

Moreover, valve spring 44 has the urging force set so that first port 51 and second port 52 are not fully connected with each other in accordance with the movement amount of valve element 43 based on the discharge pressure when control valve 40 is switched from the valve opening state to the valve closing state. With this, valve element 43 is not excessively moved at the actuation of control valve 40. Accordingly, it is possible to appropriately control control valve 40.

Figures 10A, 10B, 10C:
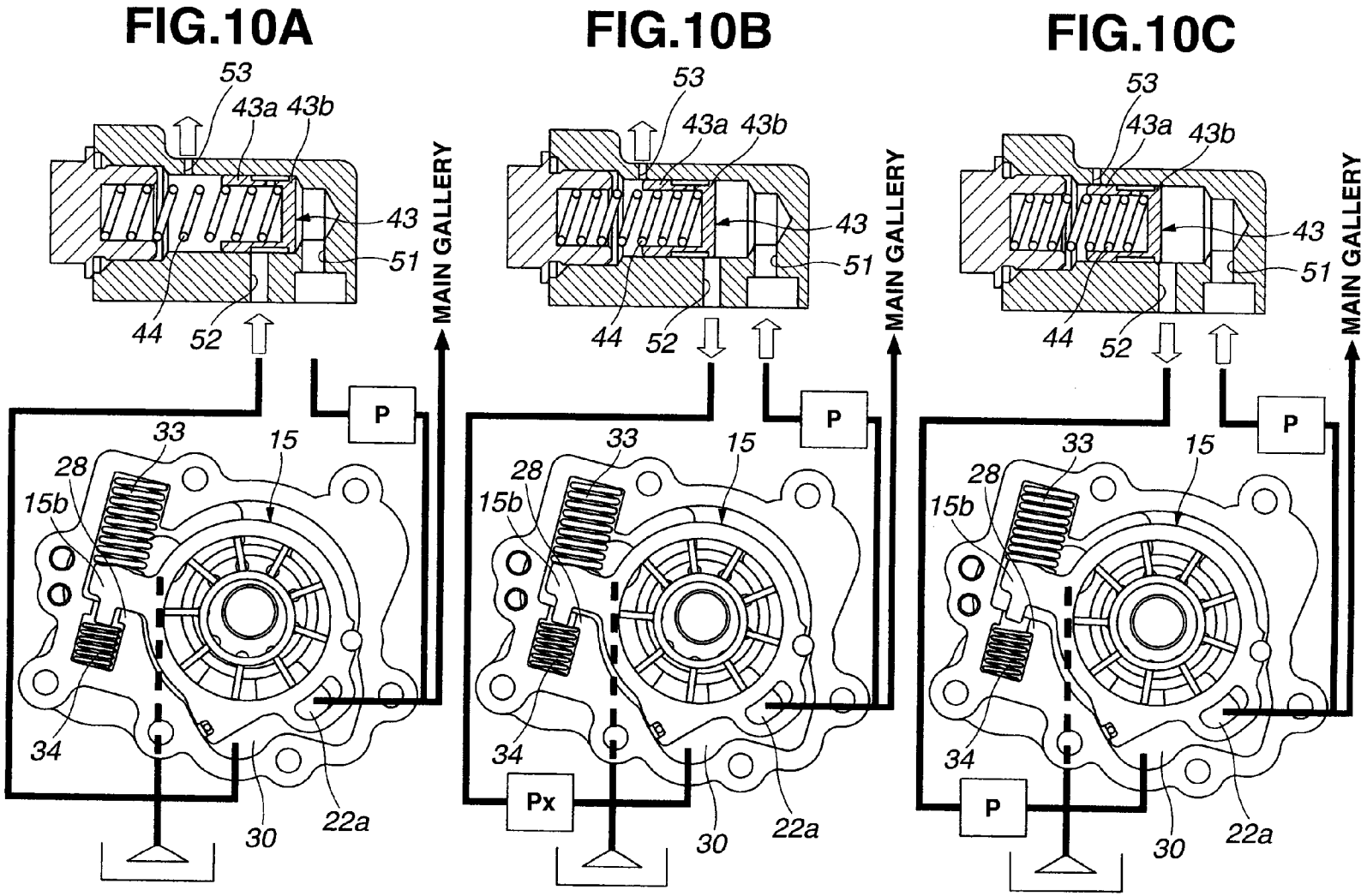
FIGS. 10A-C are hydraulic pressure circuit diagrams of a variable displacement pump according to a variation of the first embodiment of the present invention.

FIGS. 10A-10C show a variable displacement oil pump according to a variation of the first embodiment of the present invention. In a predetermined region immediately after the valve opening of control valve 40, second port 52 is simultaneously connected with first port 51 and third port 53.

That is, in the oil pump according to the variation of the first embodiment of the present invention, valve element 43 has an axial length shorter than that of valve element 43 of the oil pump according to the first embodiment. Moreover, the annular groove of valve element 43 has a groove width larger than that of the valve element 43 of the oil pump according to the first embodiment. With this, when discharge pressure P reaches port switching hydraulic pressure Pk (cf. FIG. 8) by the increase of engine speed R, control hydraulic chamber 30 is simultaneously opened to the supply passage constituted by connecting first port 51 and second port 52, and the discharge passage constituted by connecting second port 52 and third port 53, as shown in FIG. 10B. Accordingly, it is possible to further decrease the sudden variation of the internal pressure of control hydraulic chamber 30 immediately after the valve opening of control valve 40. Consequently, it is possible to further suppress the trouble of the hunting and so on of cam ring 15 based on the increase of the internal pressure.

Figures 11A, 11B, 11C:
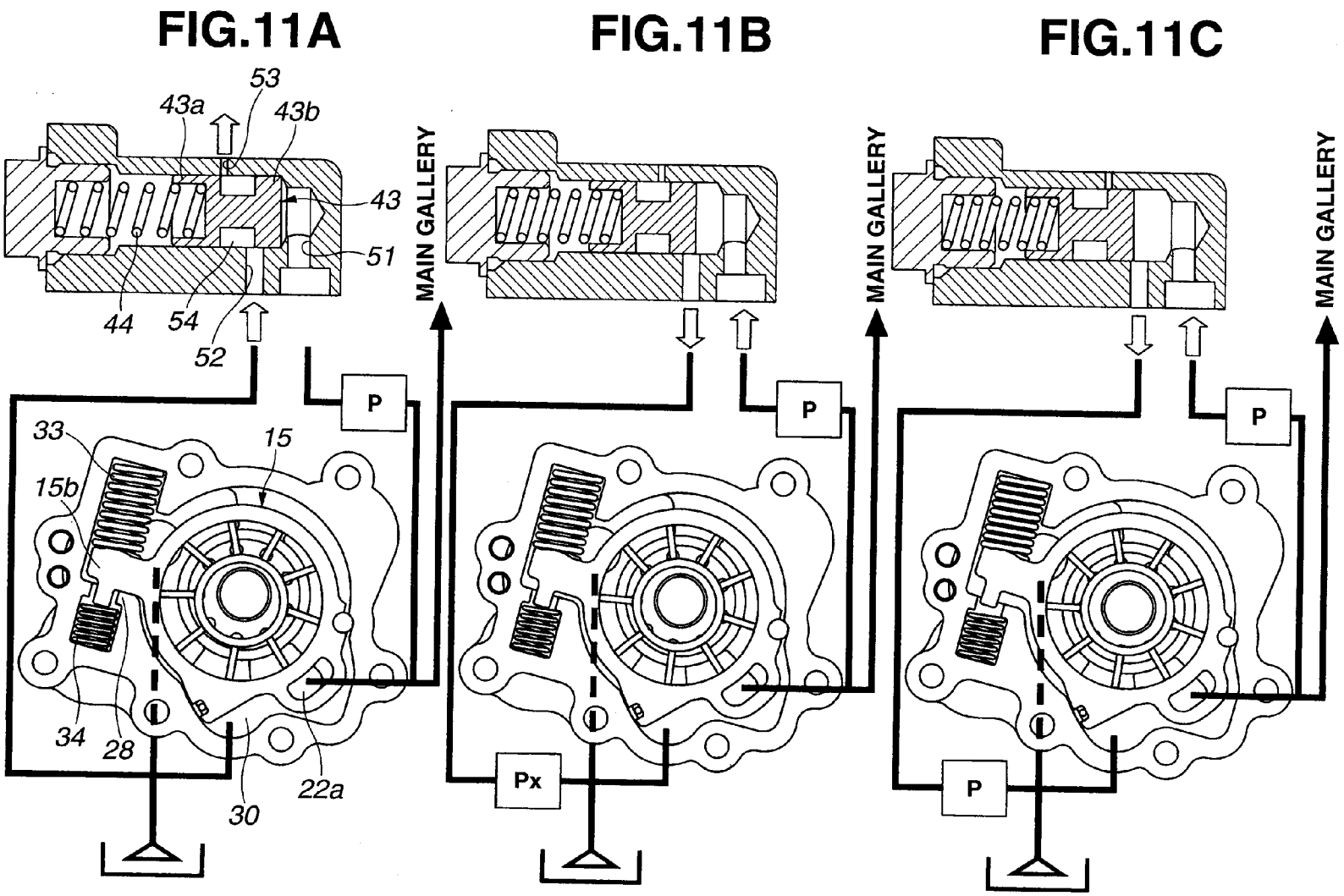
FIGS. 11A-11C are hydraulic pressure circuit diagrams of a variable displacement pump according to a second embodiment of the present invention.

FIGS. 11A-11C show a variable displacement pump according to a second embodiment of the present invention. A valve element 43 has a substantially solid cylindrical shape, unlike the first embodiment. That is, valve element 43 is formed into a spool shape. The oil pump according to the second embodiment is substantially identical to the oil pump according to the first embodiment in most aspects as shown by the use of the same reference numerals. The repetitive illustrations are omitted.

That is, in the oil pump according to the second embodiment, valve element 43 is formed into the substantially solid cylindrical shape. Valve element 43 includes first and second land portions 43*a* and 43*b* which are located on both sides of valve element 43, and which have larger diameter. Moreover, valve element 43 includes an annular space 54 which has a relatively larger width, which is located at a substantially central portion of valve element 43, which has a stepped shape to decrease its diameter, and which is separated by first and second land portions 43*a* and 43*b* and the inner circumference surface of valve body 41. By this structure, when valve element 43 is pressed against stepped portion 41*c* of valve body 41, first port 51 is closed by second land portion 43*b*, and second port 52 and third port 53 are connected with each other through annular space 54 (cf. FIG. 11A). On the other hand, when valve element 43 is moved toward the first end of valve body 41, third port 53 is closed by second land portion 43*b*, and first port 51 and second port 52 are connected with each other through a space which is located within valve element receiving portion 41*a* on the second end side of valve body 41, and which is separated by second land portion 43*b* (cf. FIGS. 11B and 11C).

Accordingly, in the oil pump according to the second embodiment, it is possible to attain the effects identical to those of the first embodiment. Moreover, it is possible to simplify the structure of control valve 40 (valve element 43) by forming valve element 43 into the spool shape. Consequently, it is possible to improve the productivity of oil pump 10, and to decrease the manufacturing cost of oil pump 10.

Figure 12B:
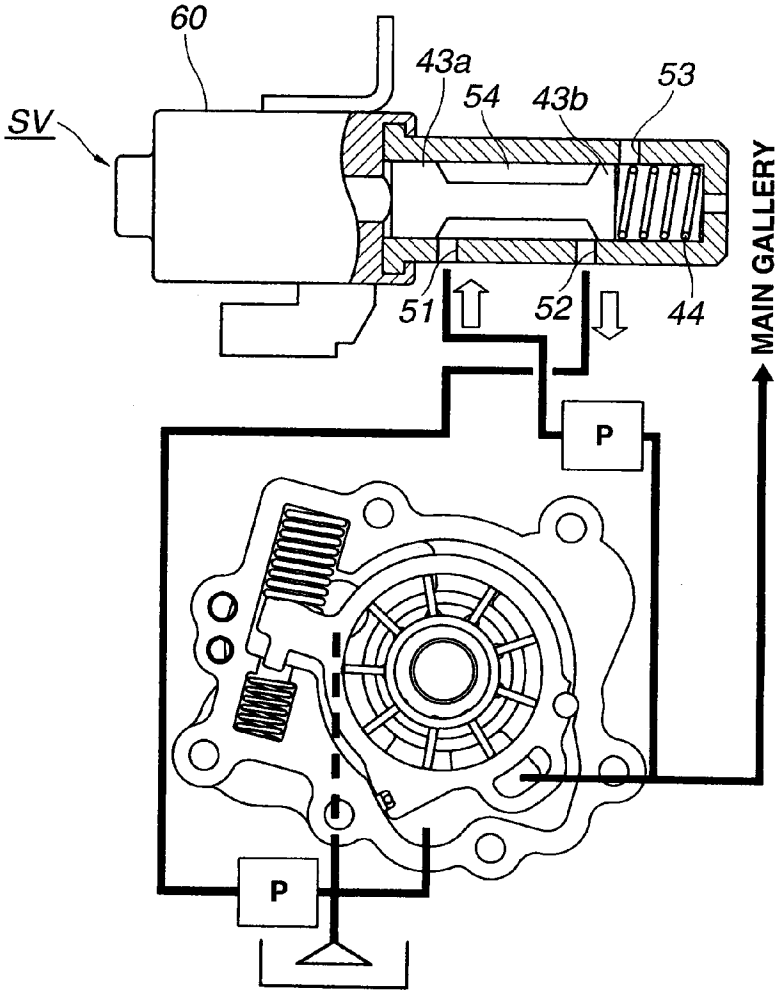
FIGS. 12A and 12B are hydraulic pressure circuit diagrams of a variable displacement pump according to a third embodiment of the present invention.
Figure 12A:
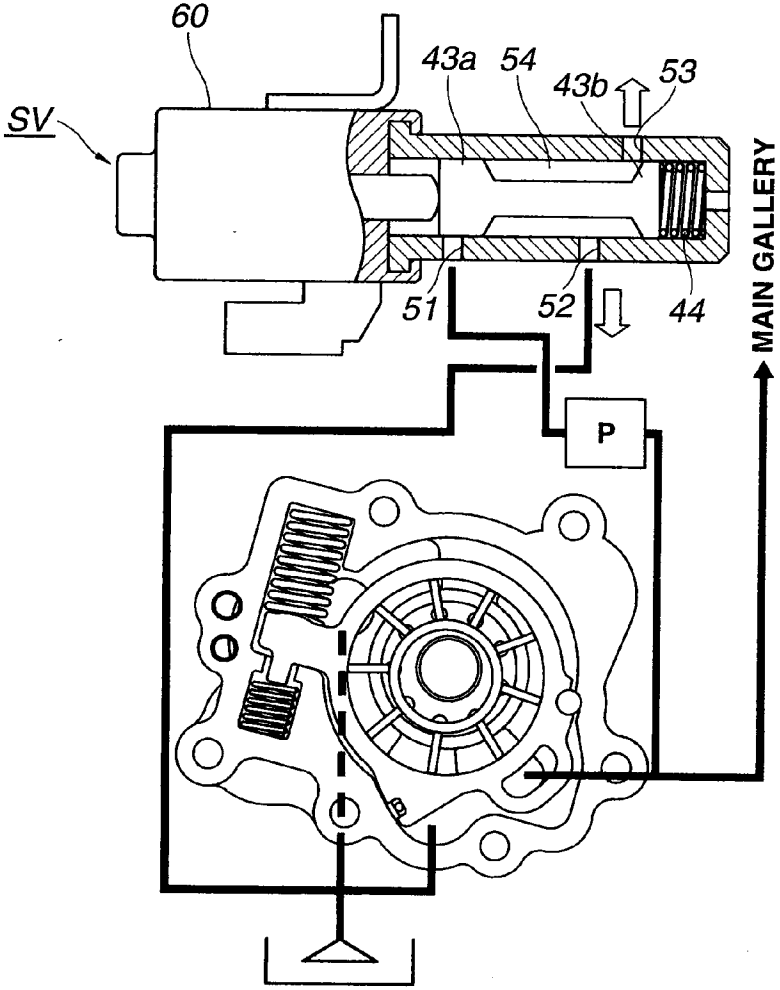

FIGS. 12A and 12B show a variable displacement pump according to a third embodiment of the present invention. In place of control valve 40 in the oil pump according to the second embodiment, a control valve 40 is constituted by a solenoid valve SV which is arranged to act in accordance with the driving state of the engine, based on an excitation current from an ECU (not shown) mounted on the vehicle. This solenoid valve SV performs the port switching control electrically. FIG. 12A shows a state in which the excitation current is applied to solenoid valve SV. FIG. 12B shows a state in which the excitation current is not applied to solenoid valve SV.

That is, solenoid valve SV is controlled by using, as a threshold value, the port switching hydraulic pressure Pk determined based on the engine speed, a water temperature, an oil temperature and so on of the internal combustion engine which are sensed by sensors and so on. In particular, when discharge pressure P is smaller than port switching hydraulic pressure Pk determined by the above-described parameters, the excitation current is applied to solenoid valve SV from the ECU. As shown in FIG. 12A, valve element 43 is moved (pressed) toward the first end side of valve body 41 (on the right side of FIG. 12A)) (side opposite to solenoid 60) in the forward direction against the urging force of valve spring 44. With this, first port 51 is closed by first land portion 43*a*, and second port 52 and third port 53 are connected with each other through annular space 54 separated by the inner circumference surface of valve body 41 and the smaller diameter portion of the central portion of valve element 43. Accordingly, control hydraulic chamber 30 is opened to the air (atmosphere) through annular space 54 and so on. Consequently, the oil within control hydraulic chamber 30 can be discharged to the outside.

On the other hand, when discharge pressure P reaches switching hydraulic pressure Pk, the excitation current is not supplied from the ECU. With this, valve element 43 is moved toward the second end side of valve body 41 (on the left side of FIG. 12B) in the rearward direction by the urging force of valve spring 44. Accordingly, third port 53 is closed by second land portion 43*b*. Instead, first port 51 and second port 52 are connected with each other through annular space 54. Discharge pressure P corresponding to port switching hydraulic pressure Pk is introduced into control hydraulic chamber 30.

In this way, the switching control by control valve 40 is electrically performed by using solenoid valve SV. Accordingly, the oil pump according to the third embodiment is not influenced by the abrasions of various portions of pump 10, and the variation of the hydraulic pressure that is caused by varying kind of the hydraulic fluid. Consequently, it is possible to smoothly and rapidly actuate (move) cam ring 15 in the section b in FIG. 8. Consequently, it is possible to more effectively suppress the power loss in this section b. Therefore, it is possible to further improve the fuel consumption.

Moreover, in this embodiment, port switching hydraulic pressure Pk is determined in consideration of the engine speed, the water temperature, the oil temperature, and so on of the internal combustion engine. Accordingly, it is possible to more appropriately control control valve 40.

In this oil pump according to the third embodiment, a linear solenoid valve can be employed as the solenoid valve SV. With this, first port 51 and second port 52 may be gradually connected with each other by the linear solenoid valve. By this structure, it is possible to suppress the variation of the hydraulic pressure within control hydraulic chamber 30 at the port switching. Accordingly, it is possible to suppress the trouble such as the hunting of cam ring 15.

The present invention is not limited to the above-described embodiments. For example, engine necessary hydraulic pressures P1-P3, first and second actuation hydraulic pressures Pf and Ps, and port switching hydraulic pressure Pk may be freely varied in accordance with specifications of the internal combustion engine, the valve timing control apparatus, and so on of the vehicle to which the oil pump 10 is mounted.

Moreover, in the embodiments, control valve 40 is provided as a member different from oil pump 10 (that is, cover member 12 constituting the housing of the pump body is a member different from valve body 41 constituting control valve 40). However, the control valve according to the present invention is not limited to the above-described structure. Cover member 12 may be integrally formed with valve body 41, so that control valve 40 may be integrally formed with oil pump 10. In case of employing the above-described structure, it is possible to simplify the structure of the hydraulic passages of connection holes 31 and 32, and ports 51-53. Accordingly, it is possible to facilitate the manufacturing operation of these hydraulic passages, and to decrease the number of the components of control valve 40. Therefore, it is possible to improve the workability of the assembly operation of oil pump 10.

A variable displacement pump according to the embodiments of the present invention includes: a rotor driven by an internal combustion engine; a plurality of vanes provided in an outer circumference portion of the rotor, and arranged to be moved in a radially inward direction of the rotor and in a radially outward direction of the rotor; a cam ring which receives the rotor and the vanes therein, which separates a plurality of hydraulic chambers with the rotor and the vanes, and which is arranged to be moved to vary an eccentric amount with respect to a center of a rotation of the rotor, and thereby to increase or decrease volumes of the hydraulic chambers at the rotation of the rotor; a housing which receives the cam ring therein, and which includes a suction portion that is formed in an inner side surface of the housing, that is opened to the hydraulic chambers whose the volumes are increased when the cam ring is moved to one side to be eccentric, and a discharge portion that is formed in the inner side surface of the housing, that is opened to the hydraulic chambers whose the volumes are decreased when the cam ring is moved to the one side to be eccentric; a first urging member arranged to urge the cam ring in a direction to increase the eccentric amount of the cam ring with respect to the center of the rotation of the rotor; a second urging member arranged to urge the cam ring in a direction to decrease the eccentric amount of the cam ring by an urging force smaller than an urging force of the first urging member when the eccentric amount of the cam ring is equal to or greater than a predetermined amount, and arranged so as not to apply the urging force to the cam ring to store the urging force when the eccentric amount of the cam ring is smaller than the predetermined amount; a control hydraulic chamber arranged to receive a discharge pressure, and thereby to move the cam ring against the urging force of the first urging member; and a hydraulic pressure introduction section configured to introduce the discharge pressure to the control hydraulic chamber when the discharge pressure becomes greater than a predetermined pressure which is in a range in which the cam ring is movable with respect to a resultant force of the urging force of the first urging member and the urging force of the second urging member, and in which the cam ring is not movable only with respect to the urging force of the first urging member.

Accordingly, in a relatively large eccentric state in which the eccentric amount of the cam ring is equal to or greater than the predetermined amount, the discharge pressure is supplied to the control hydraulic chamber after the discharge pressure reaches the predetermined pressure. Therefore, it is possible to rapidly move the cam ring against the resultant force of the urging members, and thereby to suppress the unnecessary increase of the discharge pressure at the movement of the cam ring.

On the other hand, in a relatively small eccentric state in which the eccentric amount of the cam ring is smaller than the predetermined amount, the movement of the cam ring in the concentric direction is restricted only by the urging force of the first urging member. With this, it is possible to decrease the hydraulic pressure necessary for the movement of the cam ring, to smoothly move the cam ring, and to suppress the unnecessary increase of the discharge pressure at the movement of the cam ring.

(a) In the variable displacement pump according to the embodiments of the present invention, the predetermined pressure is set greater than the discharge pressure necessary for driving a variable valve actuating device of the internal combustion engine.

(b) In the variable displacement pump according to the embodiments of the present invention, the urging force of the first urging member is set greater than an urging force acted to the cam ring when the discharge pressure necessary for driving an oil jet device arranged to cool a piston of the internal combustion engine is introduced into the control hydraulic chamber.

(c) In the variable displacement pump according to the embodiments of the present invention, the control hydraulic chamber is defined by an inner circumference surface of the housing, an outer circumference surface of the cam ring, and a pivot serving for the movement of the cam ring; and the variable displacement pump further comprises a seal member sealing between the housing and the cam ring.

(d) In the variable displacement pump according to the embodiments of the present invention, the seal member of the control hydraulic chamber is located on the suction portion's side of a boundary which passes through the center of the rotation of the rotor, and which is between the suction portion and the discharge portion.

Accordingly, the air accumulated in the control hydraulic chamber is leaked from the seal portion based on the negative pressure of the suction portion. This serves as air bleeding.

(e) In the variable displacement pump according to the embodiments of the present invention, the control valve includes a valve hole constituting a discharge passage connecting the control hydraulic chamber and the air, and a supply passage connecting the control hydraulic chamber and the discharge portion, a valve element disposed within the valve hole, and arranged to control a connection of the discharge passage and a connection of the supply passage by moving in an axial direction by the discharge pressure introduced through the first connection portion, and an urging member arranged to urge the valve element to one side in the axial direction against the discharge pressure introduced through the first connection portion.

(f) In the variable displacement pump according to the embodiments of the present invention, the valve hole has a substantially hollow cylindrical shape; the valve element has a substantially hollow cylindrical shape having a bottomed portion; the valve element is arranged to be slidably moved within the valve hole in the axial direction; and the urging member is constituted by a coil spring.

(g) In the variable displacement pump according to the embodiments of the present invention, the valve hole has a substantially hollow cylindrical shape; the valve element has a substantially solid cylindrical shape; the valve element is arranged to be slidably moved within the valve hole in the axial direction; and the urging member is constituted by a coil spring.

(h) In the variable displacement pump according to the embodiments of the present invention, the valve hole is integrally formed with the housing.

Accordingly, it is possible to simplify the structures of the connection passages, and to facilitate the manufacturing operation of the connection passages.

(i) In the variable displacement pump according to the embodiments of the present invention, the control hydraulic chamber is located on the discharge portion's side of a boundary which passes through the center of the rotation of the rotor, and which is between the suction portion and the discharge portion.

Accordingly, the hydraulic fluid within the control hydraulic chamber is not leaked at the stop of the cam ring.

(j) In the variable displacement pump according to the embodiments of the present invention, the control valve includes a drain hole arranged to discharge a hydraulic fluid within the control hydraulic chamber to the outside of the valve hole, through hydraulic passages formed in the valve element at a closing timing of the control valve.

Accordingly, it is possible to retard the opening timing of the control valve, and thereby to attain the rapid actuation of the cam ring when the eccentric amount of the cam ring is relatively large.

(k) In the variable displacement pump according to the embodiments of the present invention, the drain hole has a cross-section area smaller than a cross-section area of the hydraulic passage.

Accordingly, it is possible to decrease the variation of the hydraulic pressure of the hydraulic fluid within the control hydraulic chamber by providing the throttle to the drain hole, and to suppress the leakage of the hydraulic fluid within the control hydraulic chamber.

(l) In the variable displacement pump according to the embodiments of the present invention, the control valve includes a drain hole arranged to discharge a hydraulic fluid within the control hydraulic chamber to the outside of the valve hole, through a spool portion provided to the valve element at a closing timing of the control valve.

Accordingly, it is possible to retard the opening timing of the control valve, and thereby to attain the rapid actuation of the cam ring when the eccentric amount of the cam ring is relatively large.

(m) In the variable displacement pump according to the embodiments of the present invention, the coil spring has an urging force set so as not to fully connect the control hydraulic chamber and the discharge portion by the movement of the valve element based on the discharge pressure when the control valve is shifted from a nonactuation state to an actuation state.

Accordingly, the valve element is not excessively moved at the actuation of the control valve. Therefore, it is possible to attain the appropriate control of the control valve.

(n) In the variable displacement pump according to the embodiments of the present invention, the control valve is disposed at a position above the control hydraulic chamber in a vertical direction.

Accordingly, it is possible to discharge the air generated in the hydraulic fluid within the control hydraulic chamber, through the control valve, and thereby to suppress the trouble of the accumulation of the air generated in the hydraulic fluid within the control hydraulic chamber.

(o) In the variable displacement pump according to the embodiments of the present invention, the control valve is a solenoid valve; and the solenoid valve is configured to be closed and opened, and thereby to switch a supply of the discharge pressure to the control hydraulic chamber.

Accordingly, it is possible to more appropriately control the supply of the hydraulic pressure to the control hydraulic chamber.

(p) In the variable displacement pump according to the embodiments of the present invention, the opening and the closing of the solenoid valve is performed by using, as a threshold value, the predetermined pressure of the discharge portion.

(q) In the variable displacement pump according to the embodiments of the present invention, the threshold value is determined in accordance with an engine speed of the internal combustion engine, and a water temperature of a coolant supplied to the internal combustion engine or an oil temperature of a lubricant supplied to the internal combustion engine; and the threshold value is varied in accordance with a state of the internal combustion engine.

Accordingly, it is possible to set the threshold value to more appropriate value, and thereby to more appropriately control the control valve.

(r) In the variable displacement pump according to the embodiments of the present invention, immediately after the valve opening of the control valve, both of the discharge passage and the supply passage are in the connection states.

Accordingly, it is possible to suppress the sudden increase of the internal pressure of the control hydraulic chamber immediately after the valve opening of the control valve, and to suppress the trouble such as the hunting of the cam ring based on the increase of the internal pressure.

The entire contents of Japanese Patent Application No. 2011-114718 filed May 23, 2011 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump comprising:

a rotor driven by an internal combustion engine;

a plurality of vanes provided in an outer circumference portion of the rotor, and arranged to be moved in a radially inward direction of the rotor and in a radially outward direction of the rotor;

a cam ring which receives the rotor and the vanes therein, which separates a plurality of hydraulic chambers with the rotor and the vanes, and which is arranged to be moved to vary an eccentric amount with respect to a center of a rotation of the rotor, and thereby to increase or decrease volumes of the hydraulic chambers at the rotation of the rotor;

a housing which receives the cam ring therein, and which includes a suction portion that is formed in an inner side surface of the housing, that is opened to the hydraulic chambers whose the volumes are increased when the cam ring is moved to one side to be eccentric, and a discharge portion that is formed in the inner side surface of the housing, that is opened to the hydraulic chambers whose the volumes are decreased when the cam ring is moved to the one side to be eccentric;

a first urging member arranged to urge the cam ring in a direction to increase the eccentric amount of the cam ring with respect to the center of the rotation of the rotor;

a second urging member arranged to urge the cam ring in a direction to decrease the eccentric amount of the cam ring by an urging force smaller than an urging force of the first urging member when the eccentric amount of the cam ring is equal to or greater than a predetermined amount, and arranged so as not to apply the urging force to the cam ring to store the urging force when the eccentric amount of the cam ring is smaller than the predetermined amount;

a control hydraulic chamber arranged to receive a discharge pressure, and thereby to move the cam ring against the urging force of the first urging member; and a hydraulic pressure introduction section configured to introduce the discharge pressure to the control hydraulic chamber when the discharge pressure becomes greater than a predetermined pressure which is in a range in which the cam ring is movable with respect to a resultant force of the urging force of the first urging member and the urging force of the second urging member, and in which the cam ring is not movable only with respect to the urging force of the first urging member.

2. The variable displacement pump as claimed in claim 1, wherein the predetermined pressure is set greater than the discharge pressure necessary for driving a variable valve actuating device of the internal combustion engine.

3. The variable displacement pump as claimed in claim 1, wherein the urging force of the first urging member is set greater than an urging force acted to the cam ring when the discharge pressure necessary for driving an oil jet device arranged to cool a piston of the internal combustion engine is introduced into the control hydraulic chamber.

4. The variable displacement pump as claimed in claim 1, wherein the control hydraulic chamber is defined by an inner circumference surface of the housing, an outer circumference surface of the cam ring, and a pivot serving for the movement of the cam ring; and the variable displacement pump further comprises a seal member sealing between the housing and the cam ring.

5. The variable displacement pump as claimed in claim 4, wherein the seal member of the control hydraulic chamber is located on the suction portion's side of a boundary which passes through the center of the rotation of the rotor, and which is between the suction portion and the discharge portion.

6. The variable displacement pump as claimed in claim 4, wherein the control hydraulic chamber is located on the discharge portion's side of a boundary which passes through the center of the rotation of the rotor, and which is between the suction portion and the discharge portion.

7. A variable displacement pump comprising:

a rotor driven by an internal combustion engine;

a plurality of vanes provided in an outer circumference portion of the rotor, and arranged to be moved in a radially inward direction of the rotor and in a radially outward direction of the rotor;

a cam ring which receives the rotor and the vanes therein, which separates a plurality of hydraulic chambers with the rotor and the vanes, and which is arranged to be moved to vary an eccentric amount with respect to a center of a rotation of the rotor, and thereby to increase or decrease volumes of the hydraulic chambers at the rotation of the rotor;

a housing which receives the cam ring therein, and which includes a suction portion that is formed in an inner side surface of the housing, that is opened to the hydraulic chambers whose the volumes are increased when the cam ring is moved to one side to be eccentric, and a discharge portion that is formed in the inner side surface of the housing, that is opened to the hydraulic chambers whose the volumes are decreased when the cam ring is moved to the one side to be eccentric;

a first coil spring arranged to urge the cam ring in a direction to increase the eccentric amount of the cam ring with respect to the center of the rotation of the rotor;

a second coil spring arranged to urge the cam ring in a direction to decrease the eccentric amount of the cam ring by an urging force smaller than an urging force of the first coil spring when the eccentric amount of the cam ring is equal to or greater than a predetermined amount, and arranged so as not to apply the urging force to the cam ring to store the urging force when the eccentric amount of the cam ring is smaller than the predetermined amount;

a control hydraulic chamber arranged to receive a discharge pressure, and thereby to move the cam ring against the urging force of the first coil spring; and a control valve which includes a first connection portion connected with the discharge portion, and a second connection portion connected with the control hydraulic chamber, and which is arranged to control the discharge pressure introduced into the control hydraulic chamber by controlling a connection between the first connection portion and the second connection portion, the control valve being configured to be opened to connect the first connection portion and the second connection portion when the discharge pressure becomes greater than a predetermined pressure which is equal to or greater than a pressure at which the cam ring is movable against a resultant force of the urging force of the first coil spring and the urging force of the second coil spring, and which is equal to or smaller than a pressure at which the cam ring is movable only against the urging force of the first coil spring.

8. The variable displacement pump as claimed in claim 7, wherein the control valve includes a valve hole constituting a discharge passage connecting the control hydraulic chamber and the air, and a supply passage connecting the control hydraulic chamber and the discharge portion, a valve element disposed within the valve hole, and arranged to control a connection of the discharge passage and a connection of the supply passage by moving in an axial direction by the discharge pressure introduced through the first connection portion, and an urging member arranged to urge the valve element to one side in the axial direction against the discharge pressure introduced through the first connection portion.

9. The variable displacement pump as claimed in claim 8, wherein the valve hole has a substantially hollow cylindrical shape; the valve element has a substantially hollow cylindrical shape having a bottomed portion; the valve element is arranged to be slidably moved within the valve hole in the axial direction; and the urging member is constituted by a coil spring.

10. The variable displacement pump as claimed in claim 8, wherein the valve hole has a substantially hollow cylindrical shape; the valve element has a substantially solid cylindrical shape; the valve element is arranged to be slidably moved within the valve hole in the axial direction; and the urging member is constituted by a coil spring.

11. The variable displacement pump as claimed in claim 9, wherein the coil spring has an urging force set so as not to fully connect the control hydraulic chamber and the discharge portion by the movement of the valve element based on the discharge pressure when the control valve is shifted from a nonactuation state to an actuation state.

12. The variable displacement pump as claimed in claim 8, wherein the valve hole is integrally formed with the housing.

13. The variable displacement pump as claimed in claim 8, wherein the control valve includes a drain hole arranged to discharge a hydraulic fluid within the control hydraulic chamber to the outside of the valve hole, through hydraulic passages formed in the valve element at a closing timing of the control valve.

14. The variable displacement pump as claimed in claim 13, wherein the drain hole has a cross-section area smaller than a cross-section area of the hydraulic passage.

15. The variable displacement pump as claimed in claim 8, wherein the control valve includes a drain hole arranged to discharge a hydraulic fluid within the control hydraulic chamber to the outside of the valve hole, through a spool portion provided to the valve element at a closing timing of the control valve.

16. The variable displacement pump as claimed in claim 8, wherein the control valve is disposed at a position above the control hydraulic chamber in a vertical direction.

17. The variable displacement pump as claimed in claim 8, wherein the control valve is a solenoid valve; and the solenoid valve is configured to be closed and opened, and thereby to switch a supply of the discharge pressure to the control hydraulic chamber.

18. The variable displacement pump as claimed in claim 17, wherein the opening and the closing of the solenoid valve is performed by using, as a threshold value, the predetermined pressure of the discharge portion.

19. The variable displacement pump as claimed in claim 18, wherein the threshold value is determined in accordance with an engine speed of the internal combustion engine, and a water temperature of a coolant supplied to the internal combustion engine or an oil temperature of a lubricant supplied to the internal combustion engine; and the threshold value is varied in accordance with a state of the internal combustion engine.

20. A variable displacement pump comprising:

a pump constituting section arranged to increase or decrease volumes of a plurality of hydraulic chambers by rotating a rotor, and thereby to discharge an oil introduced from a suction portion to the hydraulic chambers, from a discharge portion;

a variable mechanism which is arranged to vary the volumes of the hydraulic chambers that are opened to the discharge portion by moving a movable member by the discharge pressure of the oil which is generated by the pump constituting section;

a first urging member arranged to urge the movable member in a direction to increase variations of the volumes of the hydraulic chambers;

a second urging member arranged to urge the movable member in a direction to decrease variations of the volumes of the hydraulic chambers by an urging force smaller than an urging force of the first urging member when the movable member is moved in a direction in which the variations of the volumes of the hydraulic chambers become equal to or greater than a predetermined amount, and arranged not to act the urging force to the movable member while having a set load when the movable member is moved in a direction in which the variations of the volumes of the hydraulic chambers are smaller than a predetermined amount;

a control hydraulic chamber arranged to receive the discharge pressure, and thereby to move the movable member against the urging force of the first urging member;

a hydraulic pressure introduction section configured to introduce the discharge pressure to the control hydraulic chamber when the discharge pressure becomes greater than a predetermined pressure which is in a range in which the movable member is movable against a resultant force of the urging force of the first urging member and the urging force of the second urging member, and in which the movable member is not movable only against the urging force of the first urging member.

* * * * *